US011026519B2

(12) United States Patent
Fan

(10) Patent No.: US 11,026,519 B2
(45) Date of Patent: Jun. 8, 2021

(54) CHILD CARRIER

(71) Applicant: Wonderland Switzerland AG, Steinhausen (CH)

(72) Inventor: Meifeng Fan, Dongguan (CN)

(73) Assignee: Wonderland Switzerland AG, Steinhausen (CH)

( * ) Notice: Subject to any disclaimer, the term of this patent is extended or adjusted under 35 U.S.C. 154(b) by 0 days.

(21) Appl. No.: 16/385,899

(22) Filed: Apr. 16, 2019

(65) Prior Publication Data

US 2019/0320819 A1 Oct. 24, 2019

(30) Foreign Application Priority Data

Apr. 19, 2018 (CN) ..... 201810355370.5
May 31, 2018 (CN) ..... 201810549110.1

(51) Int. Cl.
*A47D 13/02* (2006.01)

(52) U.S. Cl.
CPC ..... *A47D 13/025* (2013.01)

(58) Field of Classification Search
CPC ..... A47D 13/025
See application file for complete search history.

(56) References Cited

U.S. PATENT DOCUMENTS 3,780,919 A 12/1973 Hansson
5,246,152 A 9/1993 Dotseth
6,257,468 B1 * 7/2001 Yamazoe ..... A47D 13/02 224/158
8,393,505 B2 3/2013 Coote
8,453,894 B2 6/2013 Jung et al.
9,314,111 B2 4/2016 Hartwell et al.
10,076,194 B2 9/2018 Wikner et al.
10,426,275 B2 * 10/2019 Telford ..... A47D 13/025
2005/0242136 A1 11/2005 Moriguchi et al.
(Continued)

FOREIGN PATENT DOCUMENTS

AU 199532880 5/1996
CA 1332928 11/1994
(Continued)

OTHER PUBLICATIONS

Search Report of the EP Patent Application No. 19170224.0 dated Jun. 27, 2019.
(Continued)

*Primary Examiner* — Corey N Skurdal
(74) *Attorney, Agent, or Firm* — NZ Carr Law Office PLLC

(57) ABSTRACT

A child carrier includes a carrying harness, a child supporting part connected with the carrying harness, the child supporting part including a torso support portion and a neck support portion connected with each other, and a bib installable on the child supporting part to at least partially cover the neck support portion. The neck support portion is foldable over the torso support portion for adjusting the neck support portion to a desirable vertical position relative to the torso support portion, and the torso support portion includes a plurality of fastening parts operable to respectively engage with the neck support portion and the bib to hold the neck support portion in the desirable vertical position and the bib in position adjacent to the neck support portion.

19 Claims, 21 Drawing Sheets

(56) References Cited

U.S. PATENT DOCUMENTS

| | | | | |
|---|---|---|---|---|
| 2008/0283561 | A1 | 11/2008 | Parness et al. | |
| 2010/0147910 | A1 | 6/2010 | Schachtner | |
| 2010/0155446 | A1* | 6/2010 | Stein | A47D 13/025 224/576 |
| 2010/0308087 | A1 | 12/2010 | Lindbloom | |
| 2010/0308088 | A1 | 12/2010 | Lindblom | |
| 2011/0062195 | A1* | 3/2011 | Jones | A47D 13/025 224/161 |
| 2012/0061429 | A1 | 3/2012 | Sauer | |
| 2012/0241487 | A1* | 9/2012 | Zack | A47D 13/025 224/576 |
| 2012/0298702 | A1 | 11/2012 | Jung et al. | |
| 2012/0318833 | A1* | 12/2012 | Zack | A47D 13/025 224/160 |
| 2014/0263491 | A1* | 9/2014 | Telford | A47D 13/025 224/160 |
| 2015/0196133 | A1 | 7/2015 | Rosen et al. | |
| 2016/0227940 | A1 | 3/2016 | Elmberg | |
| 2016/0120334 | A1 | 5/2016 | Pond et al. | |
| 2017/0119173 | A1 | 5/2017 | Telford | |
| 2017/0150826 | A1* | 6/2017 | Salazar | A47D 13/025 |
| 2018/0206653 | A1 | 7/2018 | Andrus et al. | |

FOREIGN PATENT DOCUMENTS

| | | |
|---|---|---|
| CN | 103 622 382 | 3/2014 |
| CN | 107847057 | 3/2018 |
| CN | 105377085 | 6/2018 |
| DE | 20 2007 006204 | 10/2008 |
| DE | 20 2012 006709 | 10/2012 |
| EP | 0611234 | 8/1994 |
| EP | 3366162 | 8/2018 |
| JP | 59-21273 | 2/1984 |
| JP | H08 117067 | 5/1996 |
| JP | 10-99166 | 4/1998 |
| JP | 1998276869 | 10/1998 |
| JP | H10-276869 | 10/1998 |
| JP | 2001-137082 | 5/2001 |
| JP | 2003-225119 | 8/2003 |
| JP | 2010-524605 | 7/2010 |
| JP | 3170974 | 10/2011 |
| JP | 2012-187352 | 10/2012 |
| JP | 2012-524602 | 10/2012 |
| JP | 2012-524603 | 10/2012 |
| JP | 2013-500055 | 1/2013 |
| JP | 2013116166 | 6/2013 |
| JP | 3 198213 | 6/2015 |
| JP | 2015 131026 | 7/2015 |
| JP | 2016-512124 | 4/2016 |
| JP | 2016-532473 | 10/2016 |
| JP | 2017086740 | 5/2017 |
| JP | 6177721 | 8/2017 |
| JP | 2017-202139 | 11/2017 |
| JP | 6282716 | 2/2018 |
| JP | 2018-510017 | 4/2018 |
| JP | 2018089280 | 6/2018 |
| KR | 20-2009-0008187 | 8/2009 |
| KR | 10-2009-0010149 | 10/2009 |
| KR | 2015 0011217 | 1/2015 |
| KR | 101 493 031 | 2/2015 |
| KR | 2015 0053581 | 5/2015 |
| KR | 10-2016-0035495 | 3/2016 |
| KR | 10-2016-046224 | 4/2016 |
| KR | 1756067 | 7/2017 |
| KR | 2017105908 | 9/2017 |
| KR | 20-2017-000418 | 12/2017 |
| TW | 474799 | 2/2002 |
| TW | 296630 | 9/2006 |
| TW | 327169 | 2/2008 |
| WO | 2017/013008 | 1/2017 |
| WO | 2017013008 A1 | 1/2017 |
| WO | 2017075500 | 5/2017 |

OTHER PUBLICATIONS

Search Report of the EP Patent Application No. 19170228.1 dated Jul. 2, 2019.
Search Report of the EP Patent Application No. 19170225.7 dated Jun. 27, 2019.
Search Report of the EP Patent Application No. 19170223.2 dated Jun. 27, 2019.
Search Report of the EP Patent Application No. 19170219.0 dated Jun. 27, 2019.
Office Action of the corresponding Japanese Patent Application No. 2019-079034 dated May 12, 2020.
Office Action of the corresponding JP Patent Application No. 2019-079036 dated May 12, 2020.
Extended European Search Report of the corresponding EP Patent Application No. 19170228.1 dated May 6, 2020.
Office Action of the corresponding Canadian Patent Application No. 3040499 dated Apr. 16, 2020.
Office Action of the corresponding JP Patent Application No. 2019-079033 dated Apr. 7, 2020.
Office Action of the corresponding KR Patent Application No. 10-2019-0046049 (English Summary) dated Jul. 22, 2020.
Screenshot of Naver Blog <URL: https://creamysorrow.blog.me/130088772563> accessible dated Sep. 4, 2020.
Office Action of the corresponding KR Patent Application No. 10-2019-0046054 (English Summary) dated Jul. 28, 2020.
Office Action of the corresponding KR Patent Application No. 10-2019-0046052 (English Summary) dated Jul. 24, 2020.
Office Action of the corresponding KR Patent Application No. 10-2019-0046050 (English Summary) dated Jul. 23, 2020.
Screenshot of Naver Blog <URL: https://blog.naver.com/k2537515/30185403534> accessible dated Sep. 7, 2020.
Office Action of the corresponding JP Patent Application No. 2019-079032 (English Summary) dated May 12, 2020.
Office Action of the corresponding KR Patent Application No. 10-2019-0046047 (English Summary) dated Jul. 22, 2020.
Office Action of the corresponding JP Patent Application No. 2019-079035 (English Summary) dated Jun. 16, 2020.
EESR of the corresponding EP Patent Application No. 20215113.0 dated Feb. 4, 2021.

* cited by examiner

CHILD CARRIER

CROSS-REFERENCE TO RELATED APPLICATION(S)

This application claims priority to China patent application no. 201810549110.1 filed on May 31, 2018, and to China patent application no. 201810355370.5 filed on Apr. 19, 2018.

BACKGROUND

1. Field of the Invention

The present invention relates to child carriers.

2. Description of the Related Art

Child carrier products allow caregivers to conveniently carry and transport a young child in close contact with the caregiver without using hands. Various types of child carriers available on the market may differ in the way of carrying a child, e.g., the young child may be carried in front of the bearer in a recumbent position or facing forward or rearward, or may be carried on the back of the bearer. The child carriers may also differ in functionality, e.g., single use, dual use, etc.

The design of a child carrier has to be ergonomic to avoid concentrated stress on the bearer, and provide a comfortable environment in which the hip, waist, neck and head of the child can be adequately supported without undesirable bending or undesirable pressure on the child. Unfortunately, child carriers available on the market may still not satisfy present needs. For example, most child carriers provide a fixed space volume configuration for seating a child, which may not be adapted to the need of seating children of different sizes in different positions.

Therefore, there is a need for an improved child carrier that is more flexible and convenient in use, and can address at least the foregoing issues.

SUMMARY

The present application describes a child carrier that is flexible and convenient to use.

According to an embodiment, the child carrier includes a carrying harness, and a child supporting part connected with the carrying harness, the child supporting part including a torso support portion and a neck support portion detachably connected with each other via a fastener, wherein the fastener is engaged to connect the neck support portion with the torso support portion and disengaged to remove the neck support portion from the torso support portion.

According to another embodiment, the child carrier includes a carrying harness, a child supporting part connected with the carrying harness, the child supporting part including a torso support portion and a neck support portion connected with each other, and a bib installable on the child supporting part to at least partially cover the neck support portion. The neck support portion is foldable over the torso support portion for adjusting the neck support portion to a desirable vertical position relative to the torso support portion, and the torso support portion includes a plurality of fastening parts operable to respectively engage with the neck support portion and the bib to hold the neck support portion in the desirable vertical position and the bib in position adjacent to the neck support portion.

DETAILED DESCRIPTION OF THE EMBODIMENTS

Figure 1:
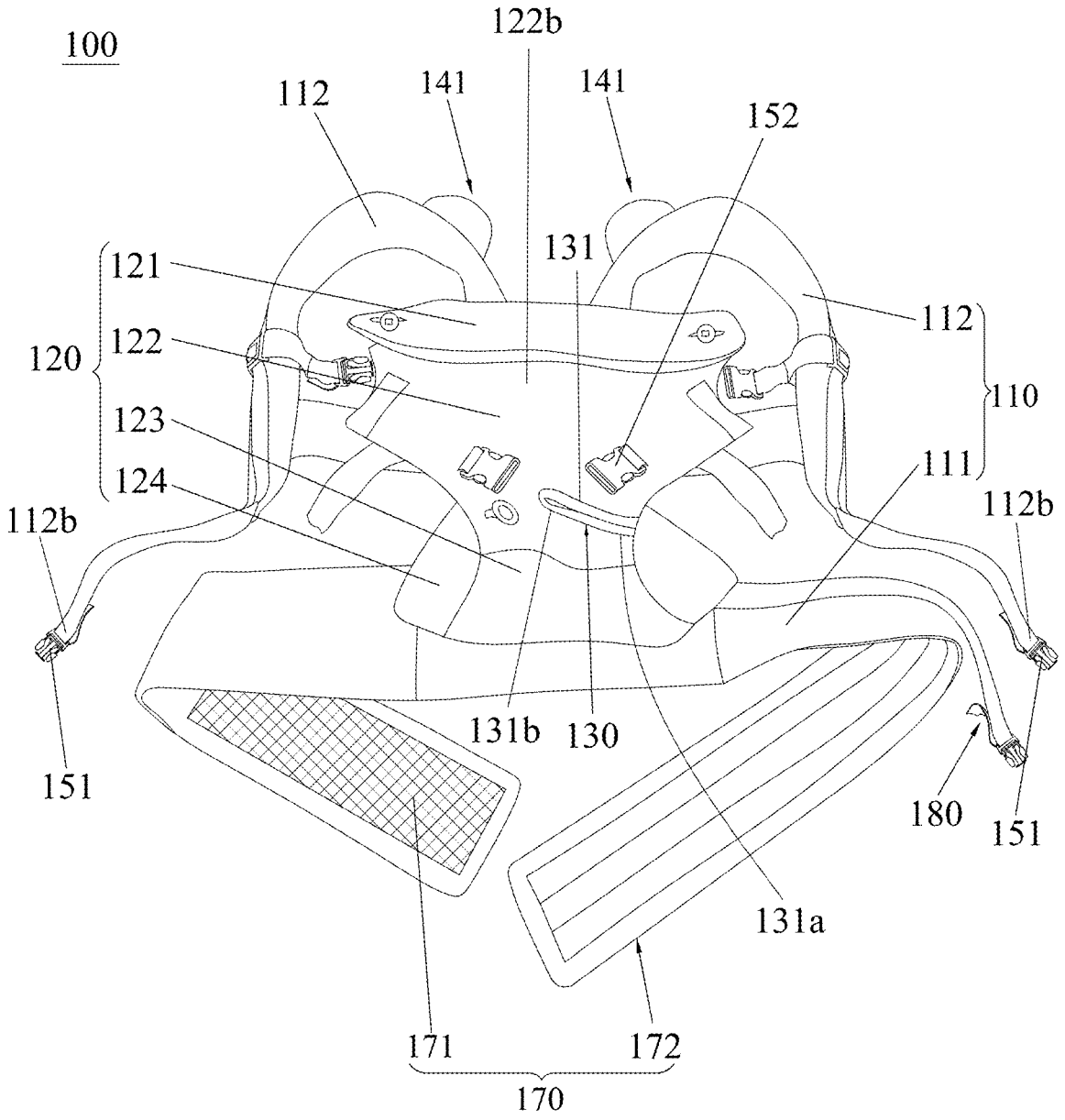
FIG. 1 is a schematic front view illustrating an embodiment of a child carrier.
Figure 2:
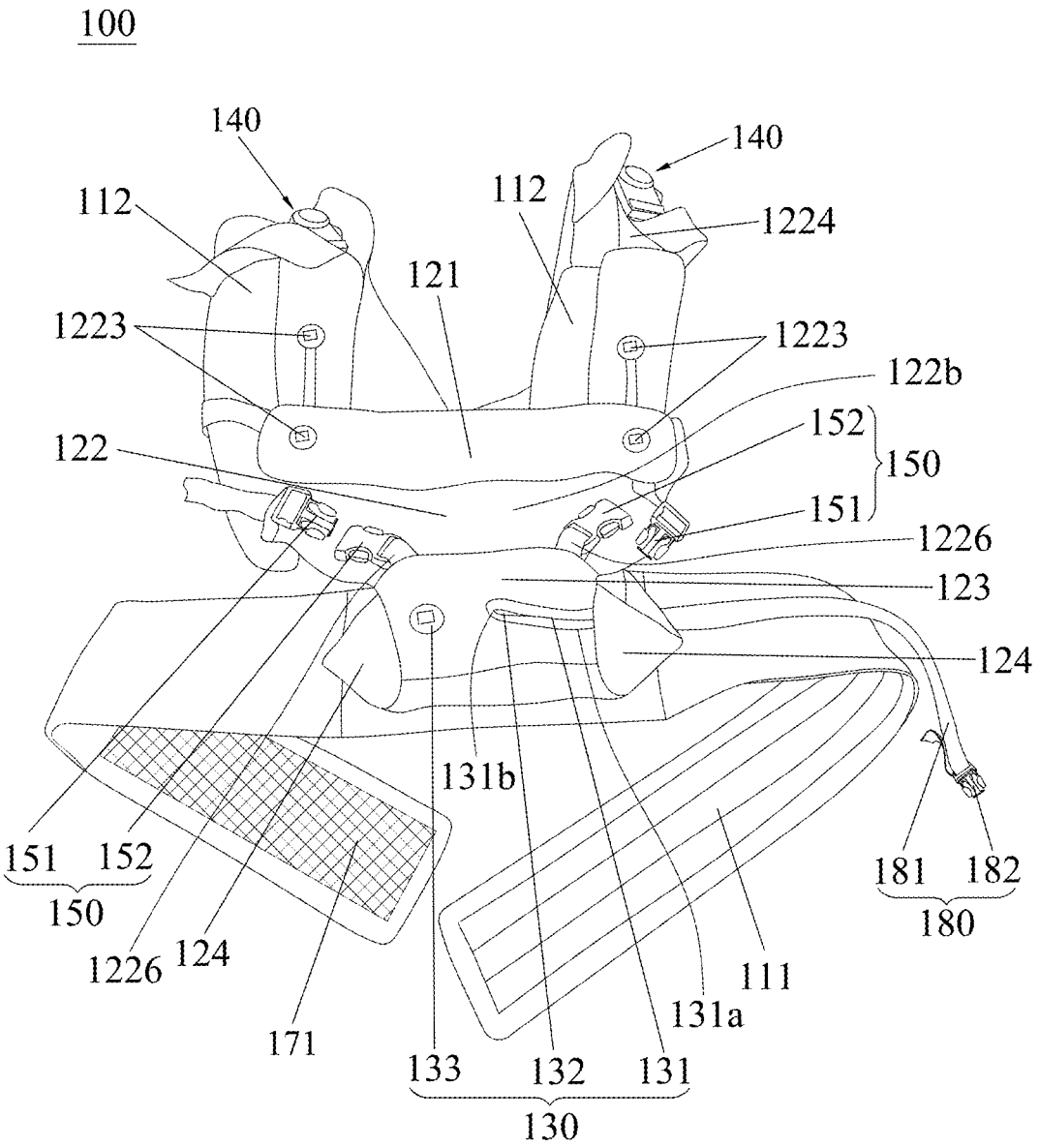
FIG. 2 is a schematic front view illustrating the child carrier of FIG. 1 in another state.

Reference is made to FIGS. 1-9 to describe an embodiment of a child carrier 100. The child carrier 100 can include a carrying harness 110 and a child supporting part 120. The child carrier 100 may be suitable for carrying and transporting a child close to a caregiver's body.

Referring to FIGS. 1-9, the carrying harness 110 can wrap around a caregiver's body when the child carrier 100 is installed and used for transporting a child. The carrying harness 110 can include a waist strap 111 and two shoulder straps 112. Each of the two shoulder straps 112 can have one fixed end 112*a* (better shown in FIGS. 6 and 7) fixedly connected with the waist strap 111, and a distal end 112*b* (better shown in FIGS. 1 and 6) that can be detachably fastened to the waist strap 111 or the child supporting part 120 (as described hereinafter).

The child supporting part 120 can be connected with the carrying harness 110. More specifically, the child supporting part 120 can be respectively connected with the shoulder straps 112 and the waist strap 111 at two opposite end portions of the child supporting part 120. According to an embodiment, the child supporting part 120 can include a neck support portion 121, a torso support portion 122 having an inner surface 122*a* (better shown in FIG. 6) and an outer surface 122*b* (better shown in FIGS. 1-3) opposite to each other, a hip support portion 123 and two thigh support portions 124. The child supporting part 120 comprised of the neck support portion 121, the torso support portion 122, the hip support portion 123 and the thigh support portions 124 may include flexible materials, which may include, without limitation, fabrics, soft goods, and the like. The hip support portion 123 is disposed between and is respectively connected with the waist strap 111 and the torso support portion 122. The two thigh support portions 124 are respectively disposed transversally opposite to each other at a left and a right side of the hip support portion 123, and are respectively connected with the hip support portion 123. According to an example of construction, the two thigh support portions 124 may be respectively disposed at an angle relative to the hip support portion 123 (shown in FIG. 6), and can fold toward the waist strap 111. Moreover, each thigh support portion 124 may have a curved shape including two opposite tapered ends and a middle that is thicker than the two tapered ends, e.g., like a crescent shape. The middle of the thigh support portion 124 may exemplary include a filling material so as to increase its thickness. In use, the hip support portion 123 and the two thigh support portions 124 are foldable relative to the waist strap 111, and can delimit at least partially a receiving space for seating a child. The thicker middle of each thigh support portion 124 can provide suitable support for the thigh so that a child can sit in a position with the knees level with the hip joint, which can provide a healthier sitting position that can facilitate natural hip development. The torso support portion 122 is foldable relative to the hip support portion 123, and can provide support for a torso of a child. The neck support portion 121 can be folded over and connected with a top of the torso support portion 122, and can be positioned adjacent to a child's neck for assisting in supporting the child's head.

Referring to FIGS. 1-5, the child carrier 100 can include a hip support adjustment 130 provided on the hip support portion 123. The hip support adjustment 130 is operable to modify a width of the hip support portion 123 according to the size and/or sitting configuration of a child. The width of the hip support portion 123 may be exemplary defined as a transversal distance between the two thigh support portions 124. It will be appreciated, however, that the width may be defined as any distance between any two points on the hip support portion 123 along the transverse direction. According to an example of construction, the hip support adjustment 130 can include an adjusting part 131 connected with the hip support portion 123. The adjusting part 131 may include a strip, a strap, a band, a panel, or the like. Examples of suitable materials for the adjusting part 131 may include flexible materials such as fabrics, elastic bands, and the like. The adjusting part 131 can extend transversally along a width direction of the hip support portion 123, and is operable to urge the hip support portion 123 to transversally contract for reducing the width of the hip support portion 123. For example, the adjusting part 131 may have at least one distal end portion operable to detachably fasten to the hip support portion 123 at one or more predetermined connecting locations thereon to adjust the width of the hip support portion 123.

Referring to FIGS. 1-5, the adjusting part 131 can exemplary have a fixed end 131*a* fixedly anchored to the hip support portion 123, and a distal end portion 131*b* operable to detachably fasten to the hip support portion 123 at a location distant from the fixed end 131*a*. The fixed end 131*a* of the adjusting part 131 may be fixedly anchored to the hip support portion 123 at a location adjacent to one of the two thigh support portions 124. Any suitable fastening structure may be used to detachably fasten the distal end portion 131*b* of the adjusting part 131 to the hip support portion 123. For example, the adjusting part 131 may have an opening 132 positioned distant from the fixed end 131*a* of the adjusting part 131, and the hip support portion 123 may have a button 133 that can engage with and disengage from the opening 132 of the adjusting part 131. According to an example of construction, only one opening 132 is provided in the adjusting part 131. It will be appreciated, however, that the adjusting part 131 may include multiple openings 132. Moreover, a distance between the fixed end 131*a* of the adjusting part 131 and the opening 132 can be smaller than the width of the hip support portion 123. The button 133 is fixedly attached to the hip support portion 123 at a location distant from the fixed end 131*a* of the adjusting part 131 along the width direction of the hip support portion 123.

The hip support adjustment 130 can be in a fastened state when the distal end portion 131*b* of the adjusting part 131 is attached to the hip support portion 123 by engaging the button 133 with the opening 132, and in an unfastened state when the distal end portion 131*b* of the adjusting part 131 is detached from the hip support portion 123 by disengaging the button 133 from the opening 132. When the hip support adjustment 130 is in the fastened state, the hip support portion 123 can be at least partially folded and contracted transversally, which reduces the width of the hip support portion 123. When the hip support adjustment 130 is in the unfastened state, the hip support portion 123 may be transversally expanded, which increases the width of the hip support portion 123. Accordingly, the width of the hip support portion 123 can be smaller when the hip support adjustment 130 is in the fastened state than when the hip support adjustment 130 is in the unfastened state. The hip support portion 123 may be thereby adjusted for receiving children of different sizes and/or in different sitting configurations.

It will be appreciated that multiple variant constructions of the hip support adjustment 130 may be possible. For example, the placement of the opening 132 and the button 133 may be interchanged: the opening 132 may be provided on the hip support portion 123, and the button 133 may be provided on the adjusting part 131. According to a variant construction, rather than having the adjusting part 131 fixedly connected with the hip support portion 123 at the fixed end thereof, the adjusting part 131 may be entirely removable from the hip support portion 123, i.e., the adjusting part 131 may have two ends that can be detachably connected with the hip support portion 123. According to another variant construction, the adjusting part 131 may fasten to the hip support portion 123 by using buckle fasteners, snap fasteners, hooks and loop fasteners, a zip fastener, a restraining belt, and the like.

Figure 3:
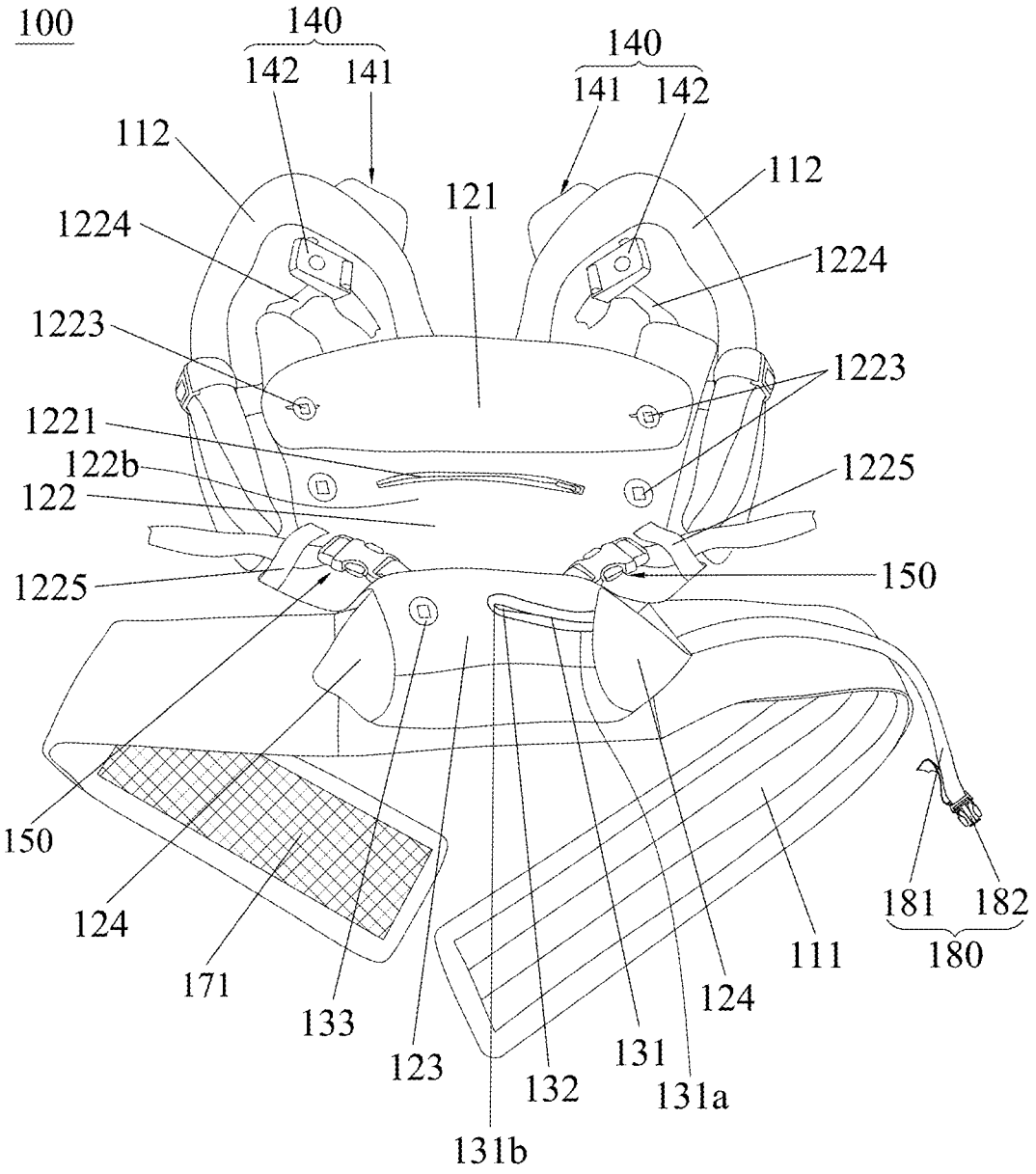
FIG. 3 is a schematic front view illustrating the child carrier of FIG. 2 with a neck support portion of the child carrier adjusted to a vertical position different from that shown in FIG. 2.
Figure 4:
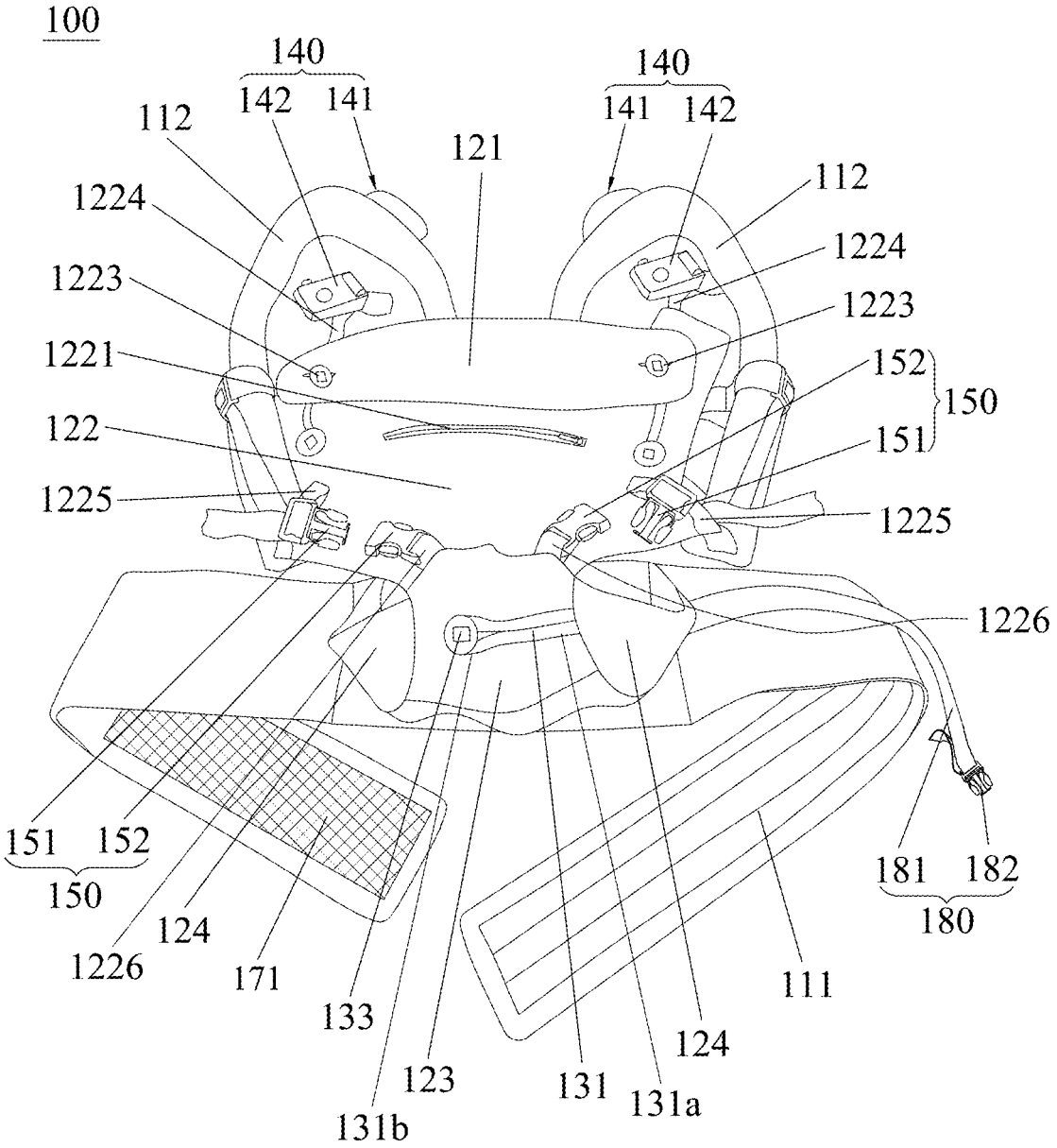
FIG. 4 is a schematic front view illustrating the child carrier of FIG. 3 with a hip support adjustment of the child carrier in a fastened state for reducing a width of a hip support portion.
Figure 5:
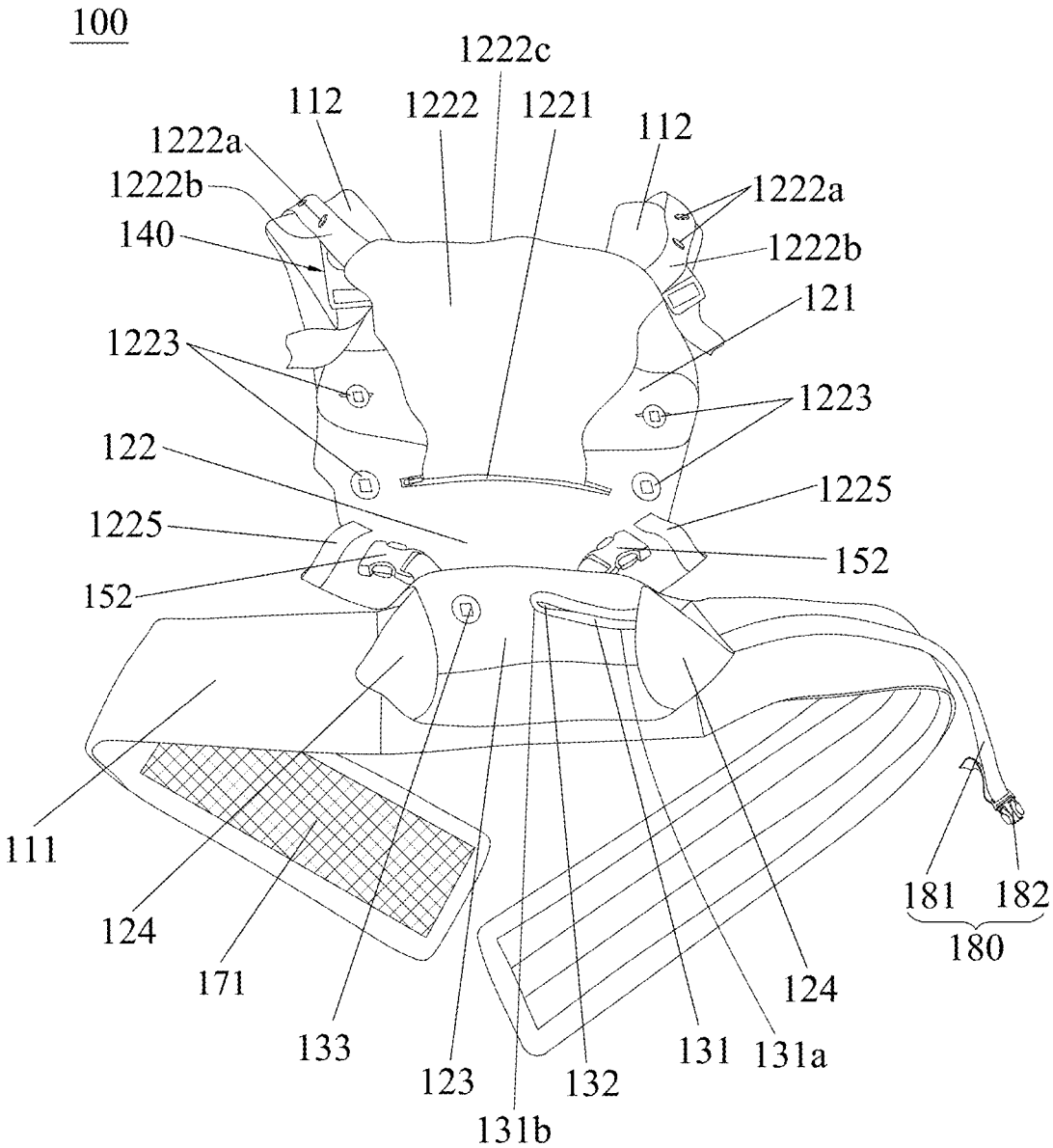
FIG. 5 is a schematic front view illustrating the child carrier of FIG. 3 having a head cover deployed outward.
Figure 6:
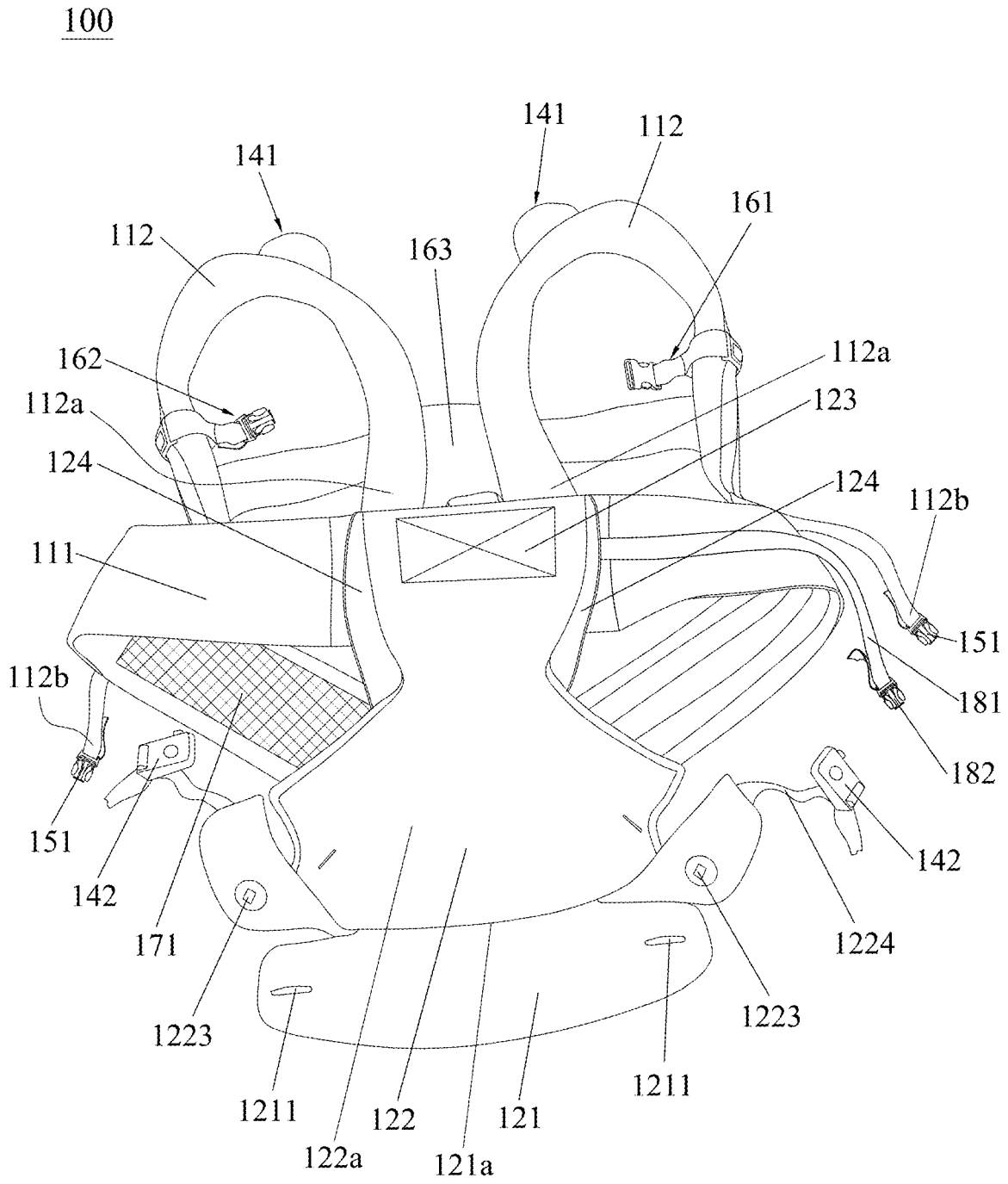
FIG. 6 is a schematic view illustrating the child carrier of FIG. 1 with a child supporting part of the child carrier flipped downward.

Referring to FIGS. 3-5, the torso support portion 122 may include a storage pocket 1221 adapted to receive a head cover 1222. The storage pocket 1221 may be placed below the neck support portion 121, and may have an opening that can be opened and closed as desired on the outer surface 122*b* of the torso support portion 122. For example, suitable fasteners that may be used for closing and opening the storage pocket 1221 may include, without limitation, zip fasteners, button fasteners, snap fasteners, hook and loop fasteners, and the like. The head cover 1222 is shaped and sized so as to be able to at least partially cover a child's head. Examples of suitable materials for the head cover 1222 may include flexible materials such as fabrics and soft goods. The head cover 1222 may be folded and stowed inside the storage pocket 1221, and deployed outward for use. According to an example of construction, the head cover 1222 may have an end fixedly connected with an interior of the storage pocket 1221 (e.g., by sewing), so that the head cover 1222 can be coupled to the torso support portion 122. This may prevent inadvertent loss of the head cover 1222, and may avoid the need of additional fasteners for connecting the head cover 1222 to the torso support portion 122. According to another example of construction, the head cover 1222 may be separable from the torso support portion 122 if required.

Referring to FIGS. 3-5, when the head cover 1222 is deployed for use, the head cover 1222 can extend from the storage pocket 1221 across the neck support portion 121 and detachably fasten to the two shoulder straps 112 of the child carrier 100 to at least partially cover and help supporting the child's head. For example, the head cover 1222 may have a plurality of fastening parts 1222*a* (better shown in FIG. 5) that can respectively engage with corresponding fastening parts 1122 (better shown in FIG. 8) provided on the shoulder straps 112. The fastening parts 1222*a* and 1122 may include, without limitation, snap fasteners, button fasteners and the like. According to an example of construction, the head cover 1222 may be connected with two belt portions 1222*b* that can protrude from a distal edge 1222*c* of the head cover 1222, and the fastening parts 1222*a* may be respectively provided on the belt portions 1222*b*. During use, the head cover 1222 can be expanded to cover a child's head, and the belt portions 1222*b* may be extended toward the shoulder straps 112 so that the fastening parts 1222*a* on the belt portions 1222*b* can respectively engage with the fastening parts 1122 on the shoulder straps 112. When the head cover 1222 is not used, the fastening parts 1222*a* and 1122 can be detached from each other, and the head cover 1222 then can be folded and stowed inside the storage pocket 1221. The belt portions 1222*b* and the fastening parts 1222*a* thereon may be stored with the head cover 1222 inside the storage pocket 1221.

It will be appreciated that the storage pocket 1221 may be provided at other suitable positions on the child supporting part 120. For example, the storage pocket 1221 may be provided in the neck support portion 121, so that the head cover 1222 can be stored inside the neck support portion 121. In this case, the head cover 1222 may be connected with the neck support portion 121, e.g., with an interior of the storage pocket 1221 provided in the neck support portion 121.

Referring to FIGS. 1-4 and 6, the neck support portion 121 can be folded over and connected with the torso support portion 122 at a top thereof. According to an example of construction, the neck support portion 121 can be fixedly connected with the top of the torso support portion 122 along a connection region 121*a* (better shown in FIG. 6) extending transversally from a left to a right side of the torso support portion 122. Moreover, the neck support portion 121 can have two end portions transversally opposite to each other along the direction of the connection region 121*a* that are respectively provided with two fastening parts 1211 (better shown in FIG. 6). Each of a left and a right side of the torso support portion 122 can respectively have a plurality of fastening parts 1223 operable to engage with and disengage from the fastening parts 1211 of the neck support portion 121. The fastening parts 1223 may be distributed at the left and right sides of the storage pocket 1221. According to an example of construction, the fastening parts 1211 provided on the neck support portion 121 may be openings, and the fastening parts 1223 provided on the torso support portion 122 may be buttons that can engage and disengage the fastening parts 1211. The fastening parts 1223 at each of the left and right sides may be exemplary provided on the outer surface 122*b* of the torso support portion 122, and may be disposed in a row generally parallel to the lengthwise axis of the child supporting part 120. According to an example of construction, the torso support portion 122 may include four fastening parts 1223, a set of two fastening parts 1223 being respectively provided at each of the left and right sides of the torso support portion 122.

According to the size of a child, the neck support portion 121 is configurable in different heights or vertical positions relative to the torso support portion 122 by folding the neck support portion 121 over the torso support portion 122. For example, the neck support portion 121 may have a first height or vertical position by applying a first fold over the torso support portion 122 (shown in FIGS. 3 and 4), and a second height or vertical position lower than the first height or vertical position by applying a second fold over the torso support portion 122 that is greater than the first fold (shown in FIGS. 1 and 2). When the neck support portion 121 is in the first vertical position, the fastening parts 1211 on the two opposite end portions of the neck support portion 121 can respectively engage with two upper ones of the fastening parts 1223 on the left and right sides of the torso support portion 122 to hold the neck support portion 121 in the first vertical position. When the neck support portion 121 is in the second vertical position, the fastening parts 1211 at the two opposite end portions of the neck support portion 121 can respectively engage with two lower ones of the fastening parts 1223 on the left and right sides of the torso support portion 122 to hold the neck support portion 121 in the second vertical position.

It will be appreciated that multiple variant constructions of the fastening parts 1211 and 1223 may be possible. For example, the fastening parts 1211 provided on the neck support portion 121 may be buttons, and the fastening parts 1223 provided on the torso support portion 122 may be openings. According to a variant construction, the fastening parts 1211 and 1223 may include magnetic fasteners, snap fasteners, hooks and loop fasteners, zipper fasteners, restraining belts, and the like. Moreover, the vertical adjustment of the neck support portion 121 relative to the torso support portion 122 may be applicable to various embodiments of the child carrier 100, including embodiments with the storage pocket 1221 for the head cover 1222 provided in the torso support portion 122 or the neck support portion 121. In an embodiment where the storage pocket 1221 for the head cover 1222 is provided in the neck support portion 121, the fastening parts 1211 may be disposed on the neck support portion 121 at a left and a right side of the storage pocket 1221, and the neck support portion 121 may be folded over the torso support portion 122 to a desirable vertical position with the head cover 1222 stored inside the neck support portion 121 or deployed outward.

The neck support portion 121 described herein is conveniently adjustable according to the size of a child to provide suitable support for the child's head. Accordingly, the neck support portion 121 can contribute to offer a comfortable and safer support for the child.

Referring to FIGS. 1-7, the child supporting part 120 and the shoulder straps 112 can detachably fasten to each other via coupling assemblies 140 and 150. The coupling assembly 140 can include two sets of connectors 141 and 142 operable to engage with and disengage from each other. For example, two connectors 141 can be respectively coupled to the two shoulder straps 112, and two connectors 142 can be respectively appended to a left and a right side of the torso support portion 122 via two belt portions 1224. More specifically, each connector 141 may be attached to the corresponding shoulder strap 112 at an intermediate position between the fixed end 112*a* and the distal end 112*b* of the shoulder strap 112. The two belt portions 1224 may be respectively attached to the torso support portion 122 adjacent to the top thereof and remotely distant from the hip support portion 123, and each connector 142 may be coupled to the corresponding belt portion 1224. According to an example of construction, the two belt portions 1224 may be respectively attached to the inner surface 122*a* of the torso support portion 122 adjacent to the top thereof. The length of each belt portion 1224 between the connector 142 thereof and the torso support portion 122 is adjustable according to the size of a child received in the child carrier 100.

Referring to FIGS. 1-4, the coupling assembly 150 can include two sets of connectors 151 and 152 operable to engage with and disengage from each other. For example, two connectors 151 can be respectively coupled to the two shoulder straps 112, and two connectors 152 can be respectively coupled to the torso support portion 122 above the hip support portion 123 and the adjusting part 131. More specifically, each connector 151 can be respectively appended at the distal end 112*b* of the corresponding shoulder strap 112 opposite to the fixed end 112*a* of the shoulder strap 112. According to an example of construction, each connector 151 may be adjustably coupled to the shoulder strap 112 so that a length of the shoulder strap 112 between the connector 151 and the fixed end 112*a* of the shoulder strap 112 is adjustable. The connectors 152 may be disposed adjacent to the hip support portion 123. According to an example of construction, each connector 152 may be respectively appended to a tab 1226 that can be affixed to the outer surface 122*b* of the torso support portion 122.

Referring to FIGS. 1-4, the outer surface 122*b* of the torso support portion 122 may further include two guide loops 1225 through which the two connectors 151 of the shoulder straps 112 can respectively pass for engagement with the two connectors 152. For example, the two guide loops 1225 may be respectively disposed above the two thigh support portions 124 and close to the two connectors 152.

According to the illustrated embodiment, the connectors 141 and 142 and the connectors 151 and 152 may include male and female connectors operable to engage into each other. According to some variant constructions, the connectors 141 and 142 and the connectors 151 and 152 may include snap fasteners, button fasteners, zipper fasteners, hook and loop fasteners, and the like.

For coupling the torso support portion 122 to the shoulder straps 112, the distal ends 112*b* of the shoulder straps 112 may be connected to the torso support portion 122 by respectively engaging the connectors 151 at the distal ends 112*b* with the connectors 152 of the torso support portion 122. Moreover, the connectors 142 of the torso support portion 122 can be respectively engaged with the connectors 141 of the shoulder straps 112. A distance between the top of the torso support portion 122 and the shoulder straps 112 may be adjusted as desired by adjusting the length of the belt portions 1224 between the connectors 142 and the torso support portion 122.

The aforementioned embodiment has the distal ends 112*b* of the shoulder straps 112 connected to the torso support portion 122 in the use configuration. According a variant embodiment, the distal ends 112*b* of the shoulder straps 112 may be connected with the waist strap 111 in the use configuration to form the closed loops for passage of the caregiver's arms, e.g., by providing the same connectors 152 at suitable positions on the waist strap 111.

Referring to FIGS. 6-9, the child carrier 100 can further include a strap restraining assembly 160 that can connect between the two shoulder straps 112. The strap restraining assembly 160 is operable to restrictedly position the two shoulder straps 112 over the caregiver's shoulders, and may include two strap fastening assemblies 161 and 162 and a linking part 163. Examples of suitable materials for the linking part 163 may include, without limitation, flexible materials such as fabrics or like soft goods. The linking part 163 may be disposed between and oppositely connected with the two shoulder straps 112, and may be positioned adjacent to the waist strap 111. The linking part 163 can assist in restrictedly position the shoulder straps 112. The two strap fastening assemblies 161 and 162 can respectively slide along the two shoulder straps 112 for adjustment, and can engage with or disengage from each other for fastening or unfastening the strap restraining assembly 160.

Figure 8:
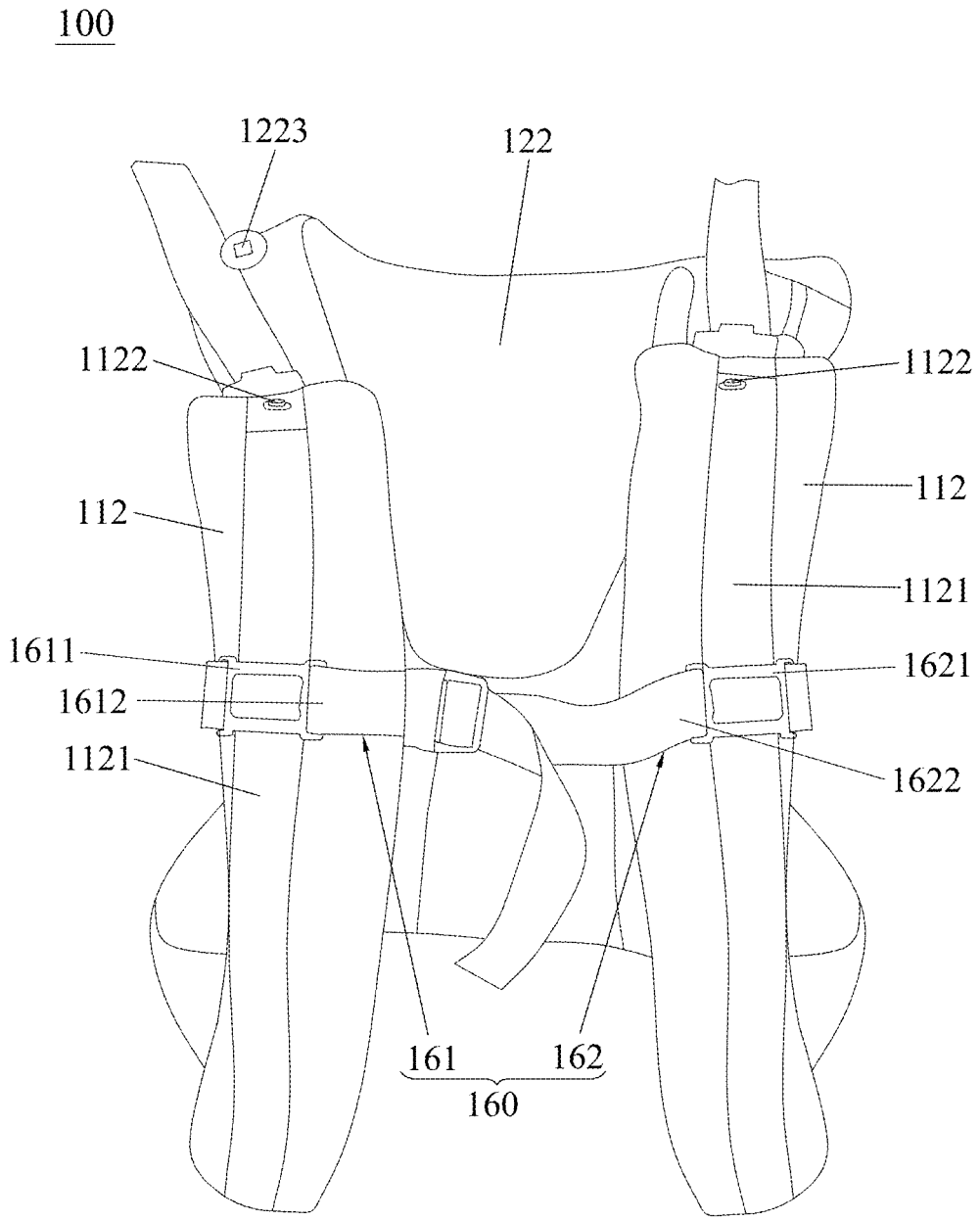
FIG. 8 is a schematic view illustrating further details of the child carrier of FIG. 1 including two shoulder straps linked to each other via two strap fastening assemblies.
Figure 9:
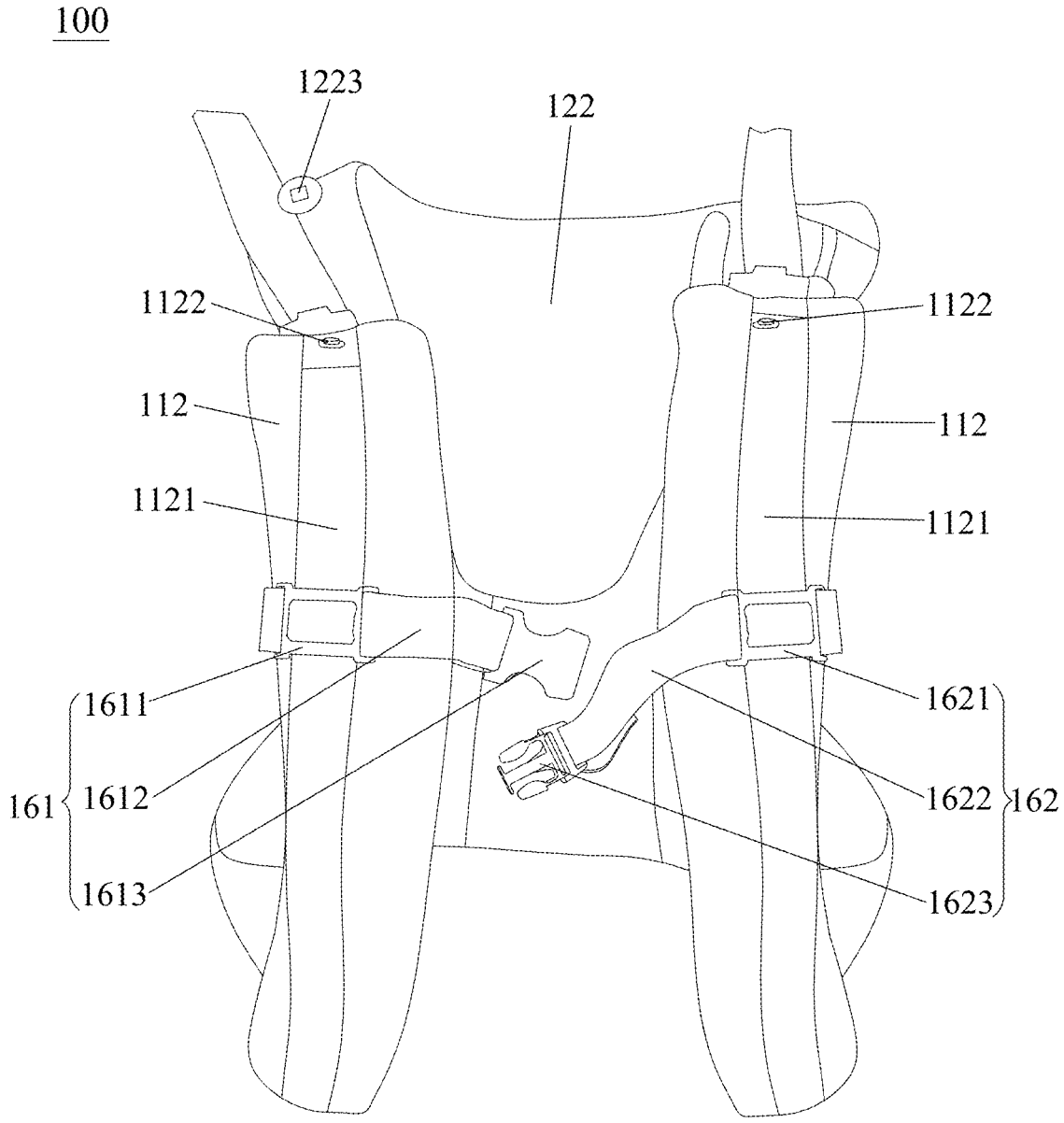
FIG. 9 is a schematic view illustrating the two strap fastening assemblies of the shoulder straps in an unfastened state.

Referring to FIGS. 8 and 9, the strap fastening assembly 161 can include a sliding part 1611, a female fastener 1613, and a belt portion 1612 respectively connected with the sliding part 1611 and the female fastener 1613. The sliding part 1611 may be slidably connected with one of the two shoulder straps 112. For example, a guide strip 1121 extending lengthwise along the shoulder strap 112 may be provided with two opposite ends affixed to the shoulder strap 112, and the sliding part 1611 may be slidably mounted on the guide strip 1121. The belt portion 1612 can wrap through and connect with the sliding part 1611, so that the belt portion 1612 and the sliding part 1611 can slide in unison along the shoulder strap 112. The female fastener 1613 can be appended to the shoulder strap 112 via the belt portion 1612.

The strap fastening assembly 162 can include a sliding part 1621, a male fastener 1623, and a belt portion 1622 respectively connected with the sliding part 1621 and the male fastener 1623. The sliding part 1621 can be slidably connected with the other one of the two shoulder straps 112, e.g., by using a guide strip 1121 like described previously. The belt portion 1622 can wrap through and connect with the sliding part 1621, so that the belt portion 1622 and the sliding part 1621 can slide in unison along the other shoulder strap 112. The male fastener 1623 can be adjustably appended to the other shoulder strap 112 via the belt portion 1622. The female fastener 1613 and the male fastener 1623 are operable to engage with and disengage from each other.

When the child carrier 100 is installed on a caregiver's body, the linking part 163 may be positioned in front of the caregiver's torso, and the female fastener 1613 and the male fastener 1623 can engage with each other at the back of the caregiver so as to restrictedly position the two shoulder straps 112 over the caregiver's torso.

Referring to FIGS. 1-7, the waist strap 111 can include an attachment system 170 for fastening or unfastening the waist strap 111 around a caregiver's waist. The attachment system 170 can include two fastening parts 171 and 172 respectively provided on two opposite ends of the waist strap 111 that can detachably engage with each other. According to an example of construction, the fastening parts 171 and 172 may include hook and loop fasteners. According to other examples of construction, the fastening parts 171 and 172 may include mutually engageable male and female fasteners, snap fasteners, button fasteners, zip fasteners, and the like.

Figure 7:
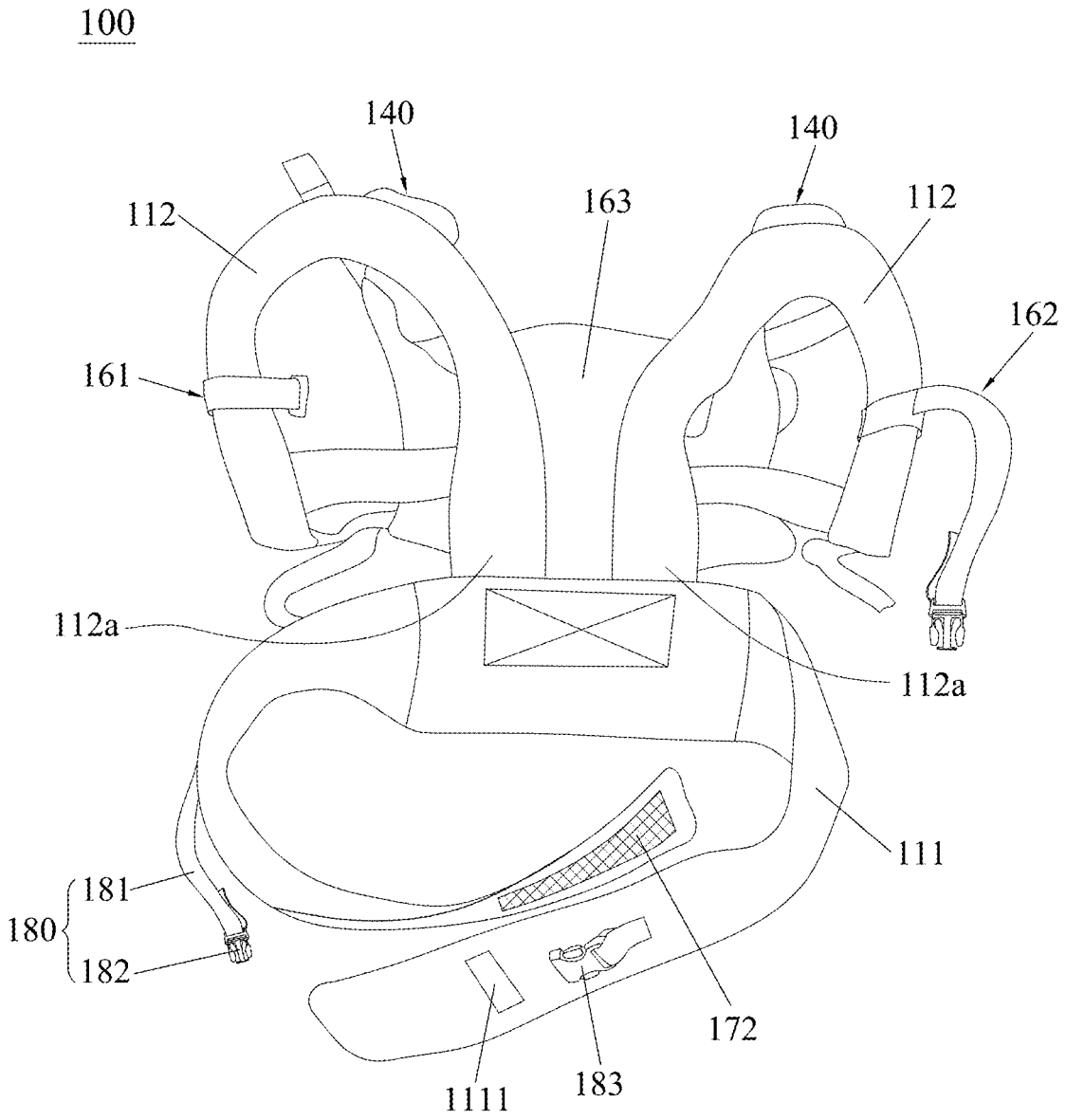
FIG. 7 is a schematic rear view illustrating the child carrier of FIG. 1.

Referring to FIG. 7, the waist strap 111 can further include a securing harness 180 operable to tighten the waist strap 111 around a caregiver's waist. The securing harness 180 can include a tightening belt 181, and two fastening parts 182 and 183. The tightening belt 181 can have one end fixedly connected with the waist strap 111, the fastening part 182 can be adjustably connected with the tightening belt 181, and the fastening part 183 can be fixedly connected with the waist strap 111. According to an example of construction, the fastening parts 182 and 183 may include male and female buckle parts operable to engage with each other. In use, after the waist strap 111 is fastened around a caregiver's waist with the attachment system 170, the tightening belt 181 can be stretched to extend across the two ends of the waist strap 111 so that the fastening part 182 on the tightening belt 181 can engage with the fastening part 183 on the waist strap 111. The waist strap 111 can be thereby tightly secured around the caregiver's waist. According to an example of construction, the waist strap 111 can further include a guide loop 1111 disposed between the fastening part 183 and an end of the waist strap 111. The guide loop 1111 may facilitate positioning of the tightening belt 181, which can pass through the guide loop 1111 for engaging the fastening part 182 with the fastening part 183.

Exemplary use of the child carrier 100 is described hereinafter with reference to FIGS. 1-9. When the child carrier 100 is to be used, the connectors 151 at the distal ends 112*b* of the shoulder straps 112 can be fastened to the connectors 152 of the torso support portion 122, and the connectors 142 of the torso support portion 122 can be respectively engaged with the connectors 141 of the shoulder straps 112. The torso support portion 122 can be thereby coupled to the shoulder straps 112, and the shoulder straps 112 can respectively define two closed loops for passage of the caregiver's arms. Moreover, the width of the hip support portion 123 may be adjusted with the adjusting part 131 according to the size of a child or the child's sitting configuration. For example, when the child is to be seated facing forward and away from the caregiver, the button 133 on the hip support portion 123 can be engaged with the opening 132 of the adjusting part 131 (as shown in FIG. 4) to reduce the width of the hip support portion 123, whereby the hip support portion 123 can more tightly support the child. When the child is to be seated facing the caregiver, the hip support portion 123 would wrap around the larger region of the child's hip, so the button 133 on the hip support portion 123 can be disengaged from the opening 132 of the adjusting part 131 (as shown in FIG. 3) to increase the width of the hip support portion 123 for a comfortable sitting environment.

Once the setup of the child carrier 100 is completed, the waist strap 111 can be fastened around a caregiver's waist by engaging the two fastening parts 171 and 172 of the attachment system 170. The waist strap 111 may then be tightened around the caregiver's waist with the securing harness 180. Subsequently, the child is held in front of the caregiver's torso, and the shoulder straps 112 and the child supporting part 120 are pulled upward together so that the child supporting part 120 wraps around the child and the shoulder straps 112 extend along a front side of the caregiver's torso and wrap around the caregiver's shoulders. The inner surface 122*a* of the torso support portion 122 can thereby face an interior volume of the child carrier 100 where the child is received, and the outer surface 122*b* can face outward. Then the two strap fastening assemblies 161 and 162 can be adjusted along the two shoulder straps 112 according to the caregiver's size, and can engage with each other for fastening the strap restraining assembly 160. A distance between the top of the torso support portion 122 and the caregiver's body may be adjusted as desired by adjusting the length of the belt portions 1224.

Figure 10:
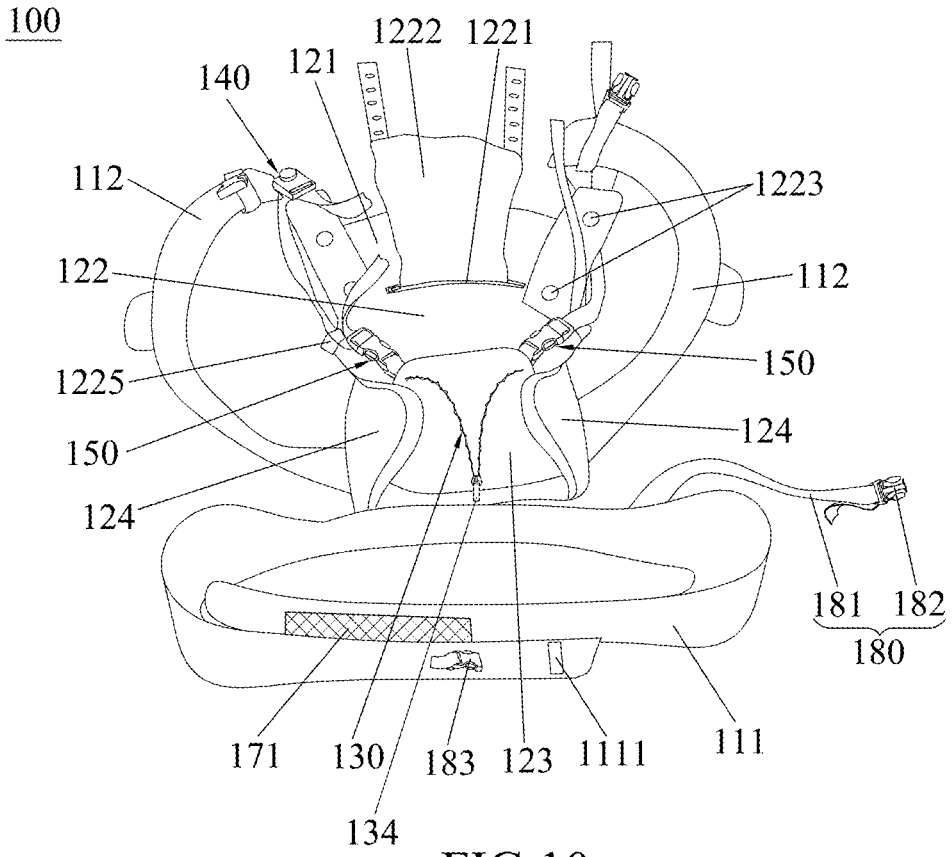
FIG. 10 is a schematic view illustrating a variant construction of the child carrier.

FIG. 10 is a schematic view illustrating a variant construction of the child carrier 100 in which the hip support adjustment 130 can include a zip fastener 134 that may serve as the adjusting part 131 described previously. The zip fastener 134 can be connected with the hip support portion 123, and can extend generally parallel to the lengthwise axis of the child supporting part 120. According to an example of construction, the zip fastener 134 can be disposed adjacent to a middle of the hip support portion 123. The zip fastener 134 can be closed to reduce the width of the hip support portion 123, and opened to increase the width of the hip support portion 123.

Figure 11:
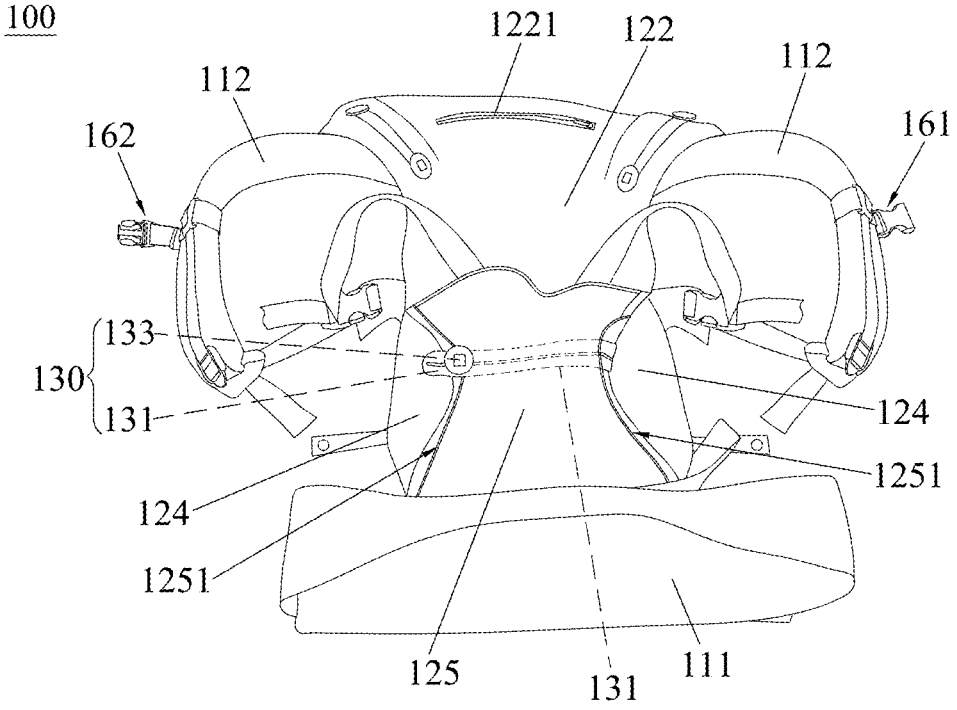
FIGS. 11 and 12 are schematic views illustrating variant constructions of the child carrier including a pocket for concealing a hip support adjustment.

FIG. 11 is a schematic view illustrating a variant construction of the child carrier 100 that may include a pocket 125. The pocket 125 can be provided in the hip support portion 123, and can be configured to conceal the hip support adjustment 130. More specifically, the hip support adjustment 130 may be disposed inside the pocket 125, and the pocket 125 can have an opening 1251 at a top or a side thereof through which the hip support adjustment 130 may be accessible for operation. Concealment of the hip support adjustment 130 inside the pocket 125 may contribute to improve the overall outer appearance of the child supporting part 120.

Figure 12:
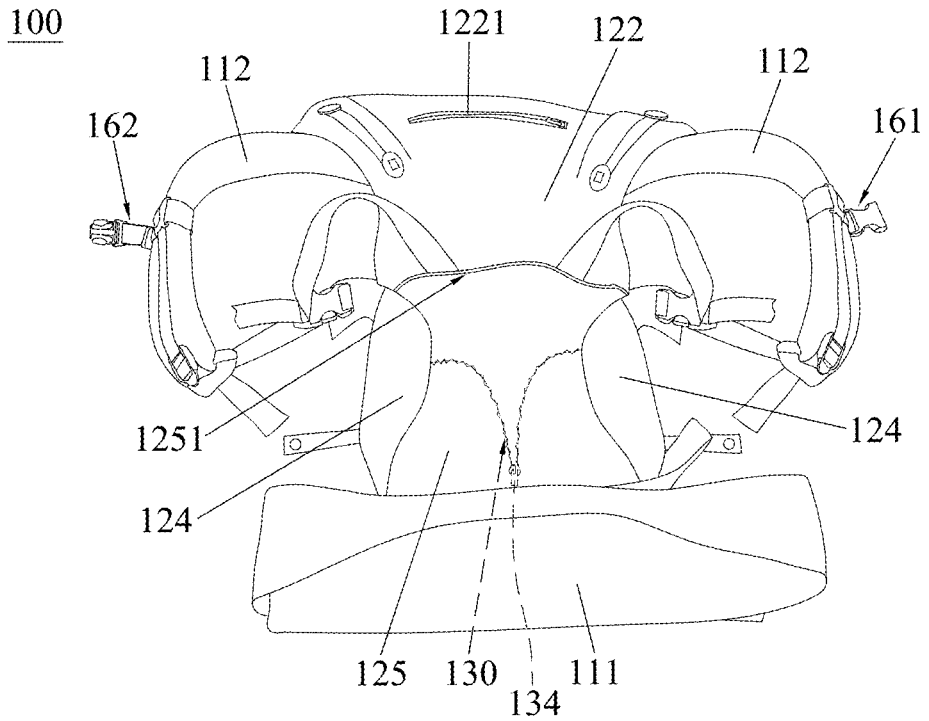

In FIG. 11, the hip support adjustment 130 concealed in the pocket 125 can exemplary include the adjusting part 131 and the button 133 as described previously in conjunction with FIGS. 1-4. In FIG. 12, the hip support adjustment 130 concealed in the pocket 125 can exemplary include the zip fastener 134 as described previously in conjunction with FIG. 10.

Figure 13:
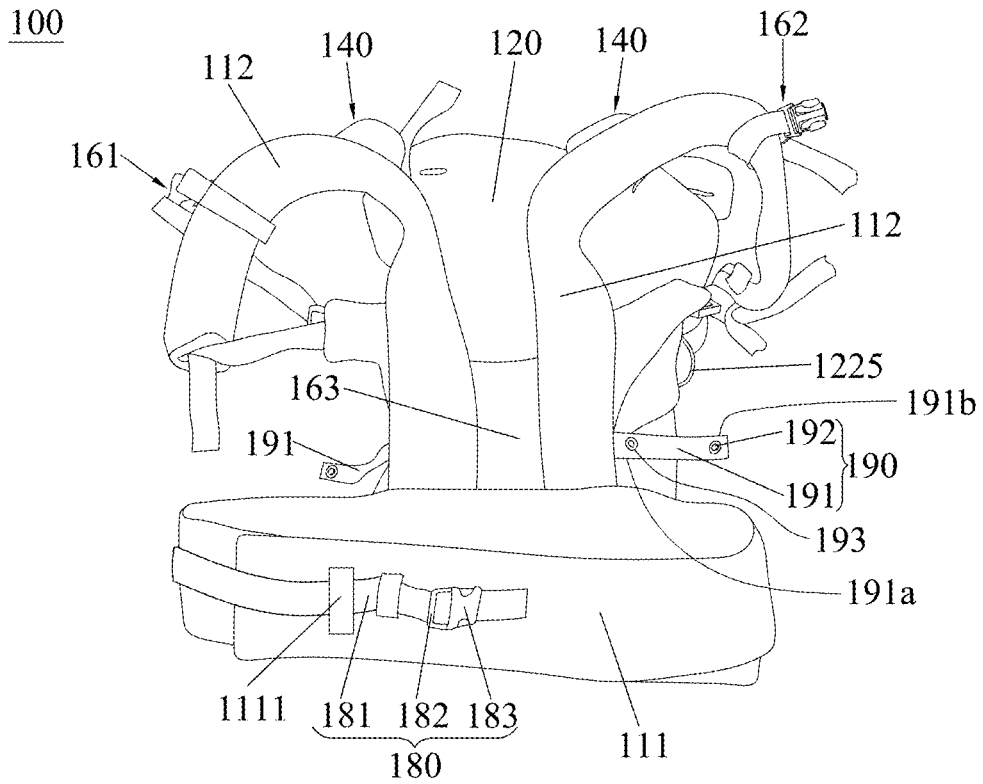
FIGS. 13-15 are schematic views illustrating another feature that may be provided in an embodiment of the child carrier.
Figure 14:
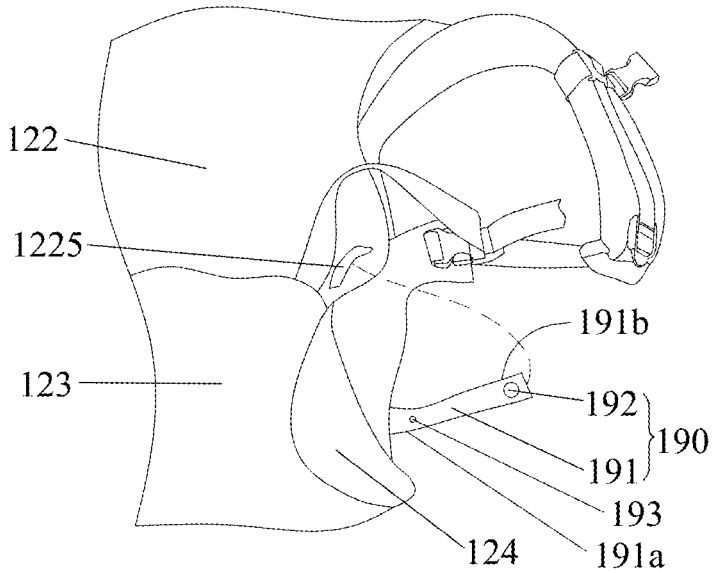
Figure 15:
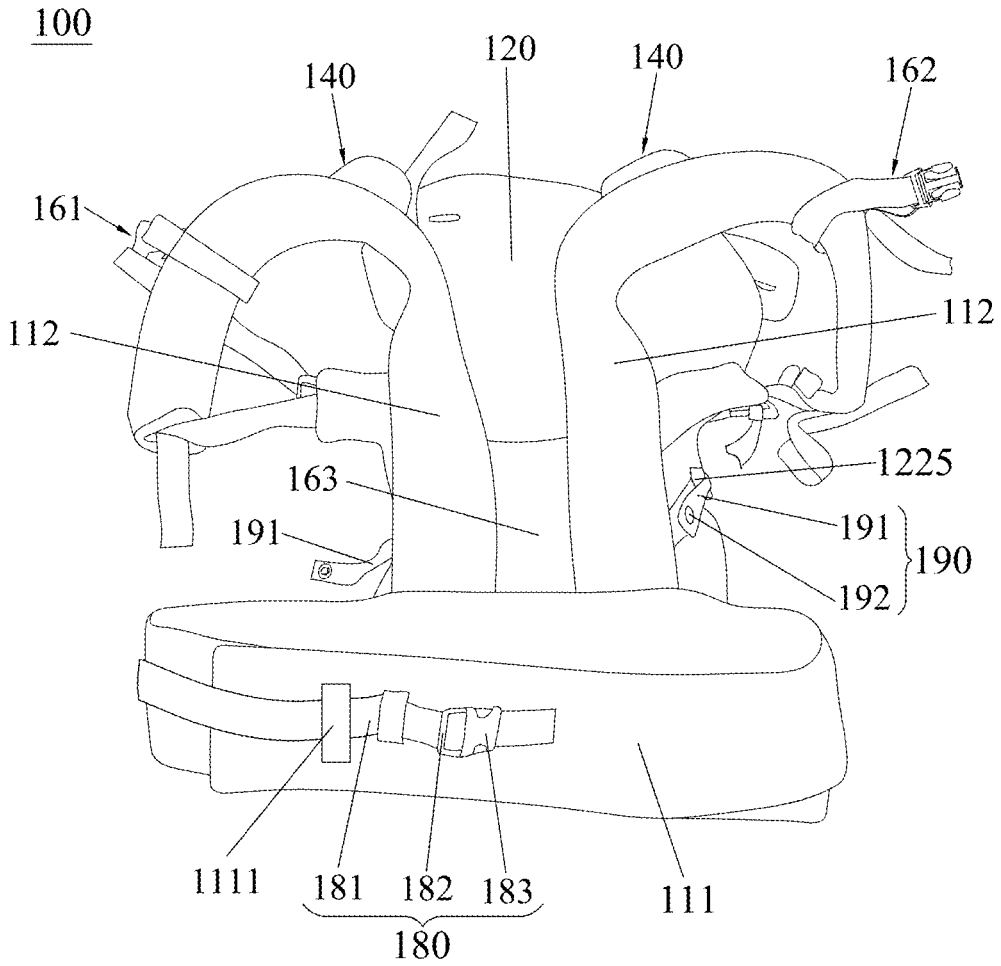

FIGS. 13-15 are schematic views illustrating another feature that may be provided in an embodiment of the child carrier 100. The child carrier 100 shown in FIGS. 13-15 may have any of the structures described previously. Referring to FIGS. 13-15, the child carrier 100 may further include two thigh restraints 190 that extend between the carrying harness 110 and the child supporting part 120 and are respectively provided close to the two thigh support portions 124 at the left and right sides. According to an example of construction, the thigh restraint 190 and the thigh support portion 124 at each of the left and right sides may at least partially delimit an adjustable restraining opening through which a thigh of a child may be positioned, the thigh restraint 190 extending above the thigh support portion 124. Once a child is installed on the child carrier 100 with a thigh of the child positioned through the restraining opening, the thigh restraint 190 can upwardly limit an upward displacement of the thigh, which may assist in suitably positioning the child and prevent the child from falling sideways off the child carrier 100.

Referring to FIGS. 13-15, according to an example of construction, the thigh restraint 190 includes a limiting part 191 that can extend between the carrying harness 110 and the child supporting part 120. The limiting part 191 may have an elongate shape, and may be comprised of a flexible material. For example, the limiting part 191 may be a flexible strip or band. Examples of suitable materials for the limiting part 191 may include, without limitation, fabrics, soft goods, and the like. According to an embodiment, the limiting part 191 may be respectively connected with the carrying harness 110 and the child supporting part 120 at a location between the thigh support portion 124 and the neck support portion 121. For example, the limiting part 191 may have a fixed end 191*a* affixed to the carrying harness 110, and may be operable to detachably connect with the torso support portion 122 at a location adjacent to the hip support portion 123 and above the thigh support portion 124. According to an example of construction, the fixed end 191*a* of the limiting part 191 may be affixed to the shoulder strap 112 at a location adjacent to and above the waist strap 111. According to another example of construction, the fixed end 191*a* of the limiting part 191 may be affixed to the waist strap 111.

Rather than respectively connecting with the carrying harness 110 and the child supporting part 120, the limiting part 191 may alternatively be connected with the child supporting part 120 at two distant locations. For example, the limiting part 191 may have the fixed end 191*a* connected with the hip support portion 123 or the thigh support portion 124, and may be operable to detachably connect with the torso support portion 122 at a location adjacent to the hip support portion 123 and above the thigh support portion 124.

When the limiting part 191 is connected with the torso support portion 122, the limiting part 191 and the thigh support portion 124 can at least partially delimit a restraining opening for positioning of a child's thigh. In addition, the limiting part 191 is operable to modify the size of the restraining opening. For example, a length of the limiting part 191 between the fixed end 191*a* and the location where the limiting part 191 connects with the torso support portion 122 may be adjustable to modify the size of the restraining opening.

According to an example of construction, the limiting part 191 may have a first fastening part 192 disposed adjacent to a distal end 191*b* of the limiting part 191 opposite to the fixed end 191*a* thereof, and one or more second fastening part 193 disposed adjacent to the fixed end 191*a* that can engage with and disengage from the first fastening part 192. The first and second fastening parts 192 and 193 may include, without limitation, button fasteners, snap fasteners, hook and loop fasteners, buckle fasteners, and the like. For forming the restraining opening, the limiting part 191 may lace through a guide loop that is provided on the outer surface 122*b* of the torso support portion 122 above the thigh support portion 124 (e.g., the guide loop 1225), and then turn back so that the first fastening part 192 engages with one of the second fastening parts 193 (as shown in FIG. 15). In a use configuration, the installed limiting part 191 can extend above the thigh support portion 124 and below the neck support portion 121, and can upwardly limit an upward movement of a child's thigh positioned through the restraining opening. The length of the limiting part 191 between the fixed end 191*a* and the location where the limiting part 191 connects with the torso support portion 122 (e.g., the guide loop 1225), which can upwardly delimit the restraining opening, can be adjusted by engaging the first fastening part 192 with a different one of the second fastening parts 193.

It will be appreciated that the thigh restraint 190 may have other constructions. For example, rather than using a lacing method, a variant construction may dispose the second fastening parts 193 on the torso support portion 122, and the first fastening part 192 on the limiting part 191 can engage with any of the second fastening parts 193 on the torso support portion 122 to form the restraining opening. According to another variant construction shown in FIG. 26, the limiting part 191 may include a plurality of first fastening parts 192 respectively formed as openings, and the torso support portion 122 may have a second fastening part 193 in the form of a button operable to selectively engage with any of the openings on the limiting part 191 for forming the restraining opening. According to another construction, the limiting part 191 may be detachably and/or adjustably fastened to one or both of the carrying harness 110 and the torso support portion 122.

FIGS. 16-19 are schematic views illustrating another variant construction that that may be applied in an embodiment of the child carrier 100. Referring to FIGS. 16-19, the neck support portion 121 may be detachably connected with a top of the torso support portion 122 via a fastener, which can be exemplary a zip fastener 126. The fastener can be engaged to connect the neck support portion 121 with the torso support portion 122, and disengaged to remove the neck support portion 121 from the torso support portion 122. Accordingly, a caregiver can easily remove and install the neck support portion 121 as needed. For example, the neck support portion 121 may be removed from the torso support portion 122 for facilitating cleaning or repair. Although the example of FIGS. 16-19 uses a zip fastener, it will be appreciated that other types of fasteners are possible for detachably connecting the neck support portion 121 with the torso support portion 122 including, without limitation, snap fasteners, button fasteners, hook and loop fasteners, and the like. Once the neck support portion 121 is connected with the torso support portion 122, the neck support portion 121 may be folded over the torso support portion 122 (e.g., along the zip fastener 126) for adjustment of the vertical position of the neck support portion 121 relative to the torso support portion 122, like described previously. The same fastening parts 1211 and 1223 described previously can be used to hold the vertical position of the neck support portion 121.

Referring to FIGS. 16-19, the storage pocket 1221 used for storing the head cover 1222 may be provided in the detachable neck support portion 121 rather than in the torso support portion 122. For example, the storage pocket 1221 may be placed in a central region of the neck support portion 121, and the fastening parts 1211 of the neck support portion 121 may be positioned at a left and a right side of the storage pocket 1221. The opening of the storage pocket 1221 may be exemplary closed and opened with one or more snap fastener 1221*a*. Other suitable fasteners for closing and opening the storage pocket 1221 may include, without limitation, zip fasteners, button fasteners, hook and loop fasteners, and the like. According to an example of construction, the head cover 1222 may have an end fixedly connected with an interior of the storage pocket 1221, so that the head cover 1222 is coupled to the neck support portion 121. The head cover 1222 may be folded and stowed inside the storage pocket 1221, and deployed outward for use. When the head cover 1222 is deployed for covering a child's head, the head cover 1222 may detachably fasten to the two shoulder straps 112 of the child carrier 100 to help supporting the child's head. For example, the head cover 1222 may have two belt portions 1222*b* (better shown in FIG. 16) respectively provided with fastening parts 1222*a* that can respectively engage with corresponding fastening parts 1122 provided on the shoulder straps 112. When the head cover 1222 is unused, the belt portions 1222*b* and the fastening parts 1222*a* thereon may be stored with the head cover 1222 inside the storage pocket 1221.

Figure 20:
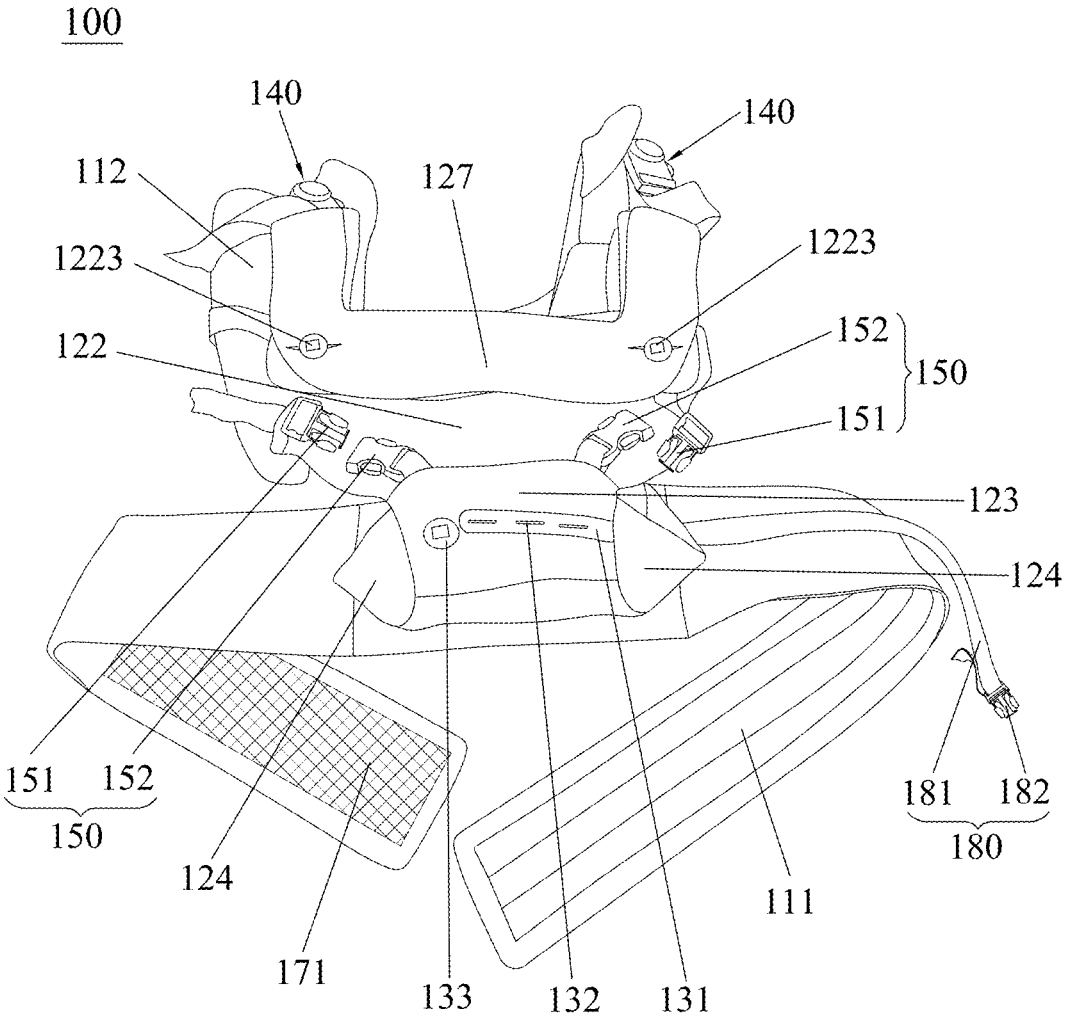
FIG. 20 is a schematic view illustrating an embodiment of the child carrier including a bib installed on a neck support portion.
Figure 21:
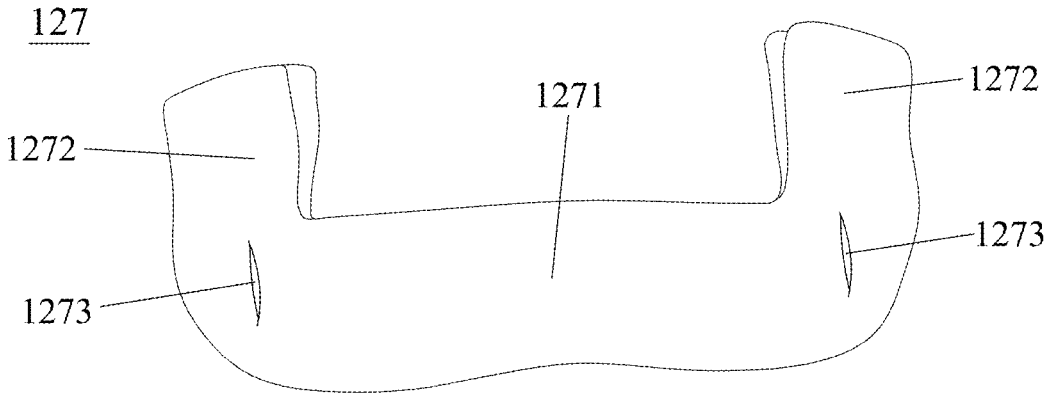
FIG. 21 is a schematic view illustrating the bib alone.

FIGS. 20 and 21 are schematic views illustrating another feature that may be provided in an embodiment of the child carrier 100. Referring to FIGS. 20 and 21, the child carrier 100 may include a bib 127 that is installable on the child supporting part 120 to at least partially cover and protect the neck support portion 121. The neck support portion 121 may be permanently affixed to or detachably connected with the torso support portion 122, and can be adjusted between a plurality of vertical positions relative to the torso support portion 122 by folding the neck support portion 121 over the torso support portion 122 as described previously. The bib 127 may be installed adjacently on the neck support portion 121 while the neck support portion 121 is in any desirable vertical positions relative to the torso support portion 122. For convenient and flexible use, the bib 127 may be attached to and detached from the child supporting part 120 as desired. For example, the bib 127 may be detachably fastened to the neck support portion 121 and/or the torso support portion 122 of the child supporting part 120.

According to an example of construction, the bib 127 may have a generally U-shape, including a transversal portion 1271 and two side portions 1272 protruding from the transversal portion 1271 at two opposite sides thereof. Examples of suitable materials for the bib 127 can include, without limitation, fabrics and soft goods. The bib 127 can include a plurality of openings 1273 for attachment of the bib 127 to the child supporting part 120. For example, two openings 1273 may be respectively disposed on the bib 127 adjacent to the two connecting regions where the two side portions 1272 respectively join with the transversal portion 1271. In use, the bib 127 may be disposed to cover at least partially the neck support portion 121, and fastening parts provided on the torso support portion 122 can respectively engage with the openings 1273 to hold the bib 127 in position. Examples of suitable fastening parts provided on the torso support portion 122 for engaging with the openings 1273 of the bib 1273 can include buttons. According to one embodiment, the fastening parts 1223 provided on the torso support portion 122 for holding the different vertical positions of the neck support portion 121 may also engage with the openings 1273 to hold the bib 127 in position. For example, two of the fastening parts 1223 can respectively engage with the neck support portion 121 and the bib 127 to hold the neck support portion 121 in a desired vertical position and the bib 127 in position adjacent to the neck support portion 121. Once the bib 127 is positioned on the neck support portion 121, the two side portions 1272 of the bib 127 can at least partially cover at least some of the fastening parts 1223 and the two belt portions 1224.

In addition to or alternatively to the aforementioned fastening parts provided on the torso support portion 122, it will be appreciated that the neck support portion 121 may also have fastening parts operable to engage with the bib 127 to hold the bib 127 in position.

FIGS. 22-26 are schematic views illustrating another feature that may be provided in an embodiment of the child carrier 100. Referring to FIGS. 22-26, the child carrier 100 may include an expandable part 128 operable to adjust a greatest bottom distance between the torso support portion 122 and the carrying harness 110, in particular a greatest bottom distance between the torso support portion 122 at one end, and the waist strap 111 or a region that is adjacent to the waist strap 111, the shoulder straps 112 and/or the linking part 163 at the other end. The expandable part 128 may be a panel, a strip, a band, or the like. Examples of suitable materials for the expandable part 128 may include, without limitation, fabrics, soft goods, and like flexible materials. The expandable part 128 can be disposed above the hip support portion 123. An end 128*a* (better shown in FIG. 23) of the expandable part 128 may be affixed to the waist strap 111, or to the child supporting part 120 at a region adjacent the connection between the child supporting part 120 and the waist strap 111. Another end 128*b* (better shown in FIG. 23) of the expandable part 128 opposite to the end 128*a* may be affixed to the torso support portion 122 adjacent to a bottom thereof, e.g., adjacent to the connection between the torso support portion 122 and the hip support portion 123. The expandable part 128 can have an adjustable effective length that links the torso support portion 122 to the carrying harness 110, which can define the greatest bottom distance allowed between the torso support portion 122 and the carrying harness 110. For example, the expandable part 128 can be connected with a fastening structure 1281 operable to modify and adjust the effective length of the expandable part 128, which can thereby adjust the greatest bottom distance between the torso support portion 122 and the carrying harness 110. When the fastening structure 1281 is configured to reduce the greatest bottom distance between the torso support portion 122 and the carrying harness 110, the effective length of the expandable part 128 can be smaller than the total length of the expandable part 128 between the two ends 128*a* and 128*b* thereof.

Figure 22:
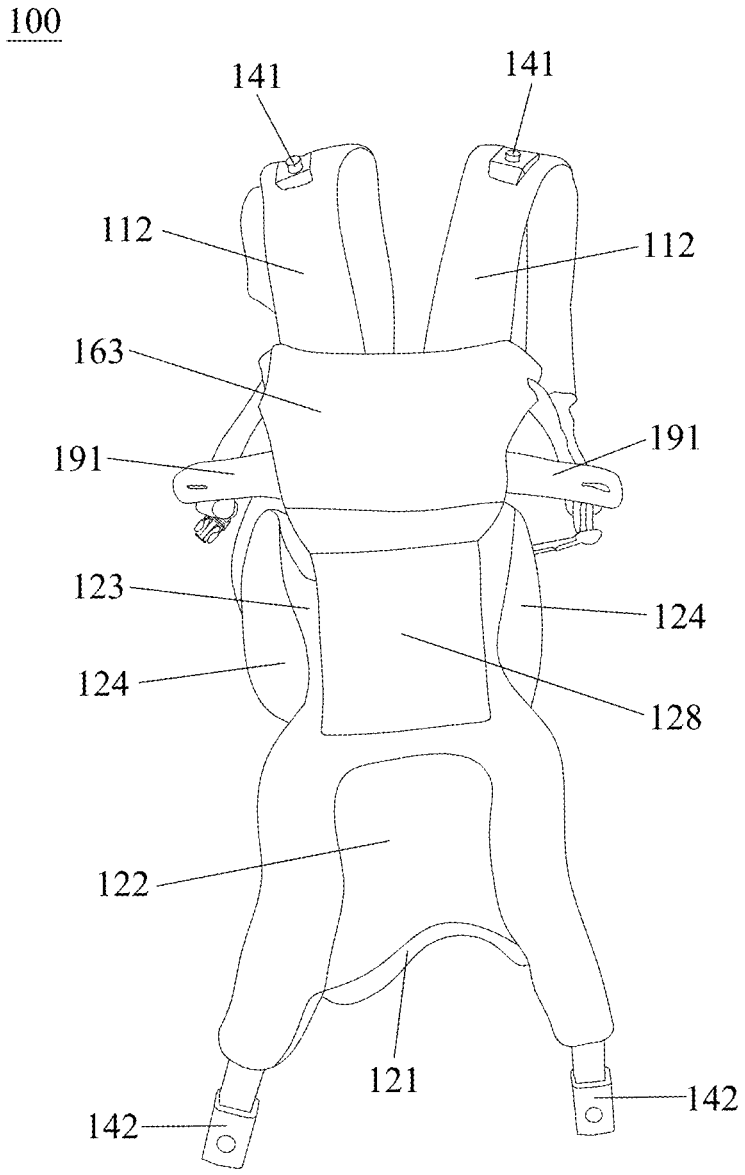
FIG. 22 is a schematic view illustrating an embodiment of the child carrier including an expandable part operable to adjust a greatest bottom distance between a torso support portion and a carrying harness of the child carrier.
Figure 23:
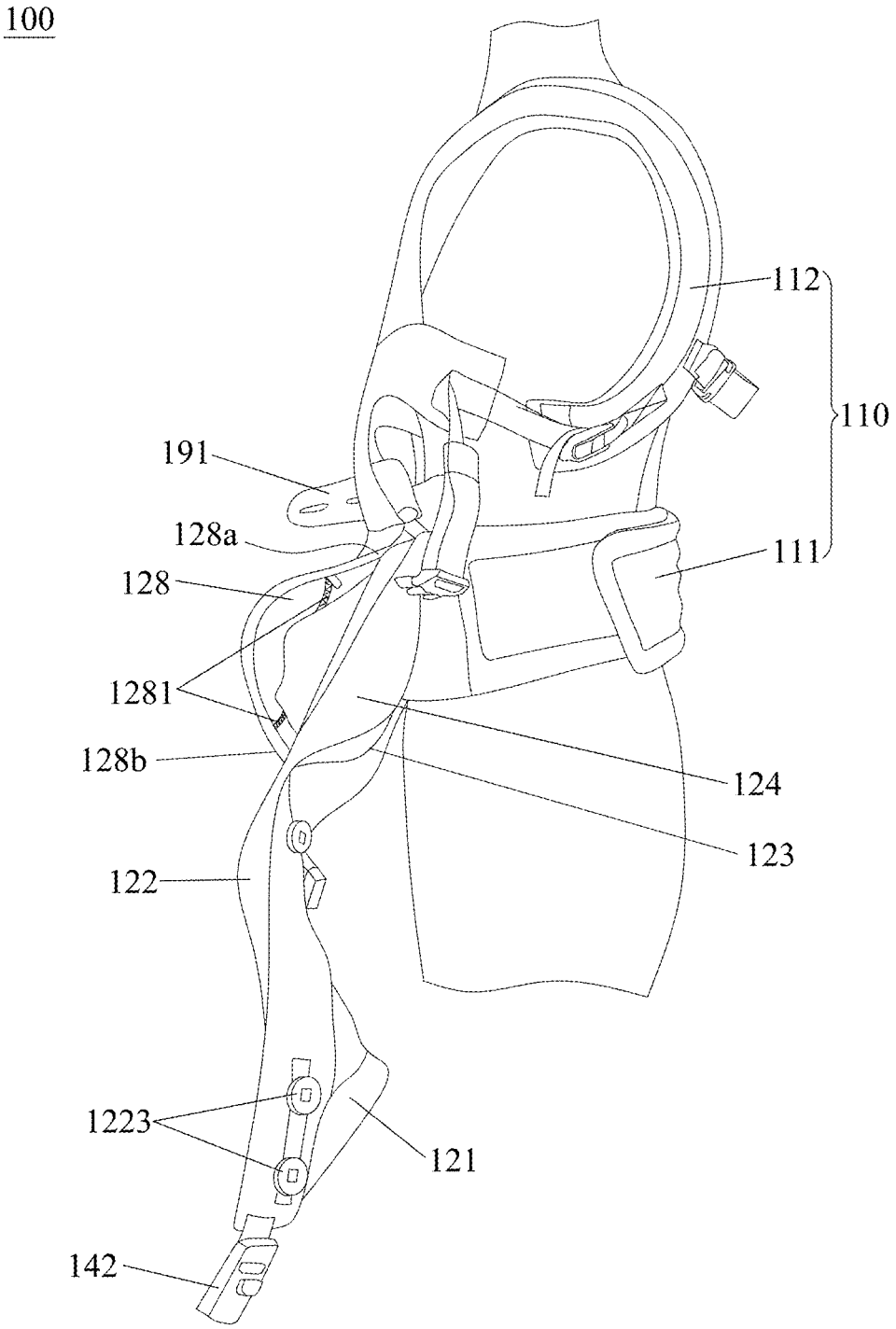
FIG. 23 is a side view illustrating the child carrier of FIG. 22.
Figure 24:
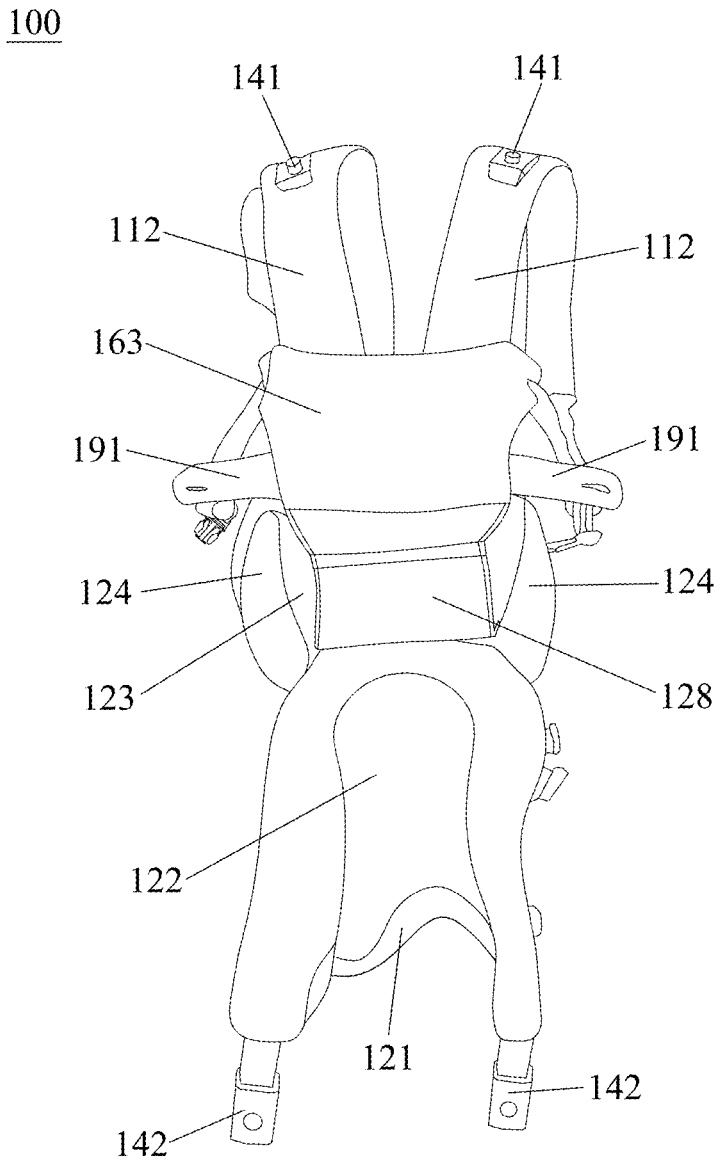
FIG. 24 is a schematic view illustrating exemplary adjustment of the expandable part in the child carrier shown in FIG. 22.
Figure 25:
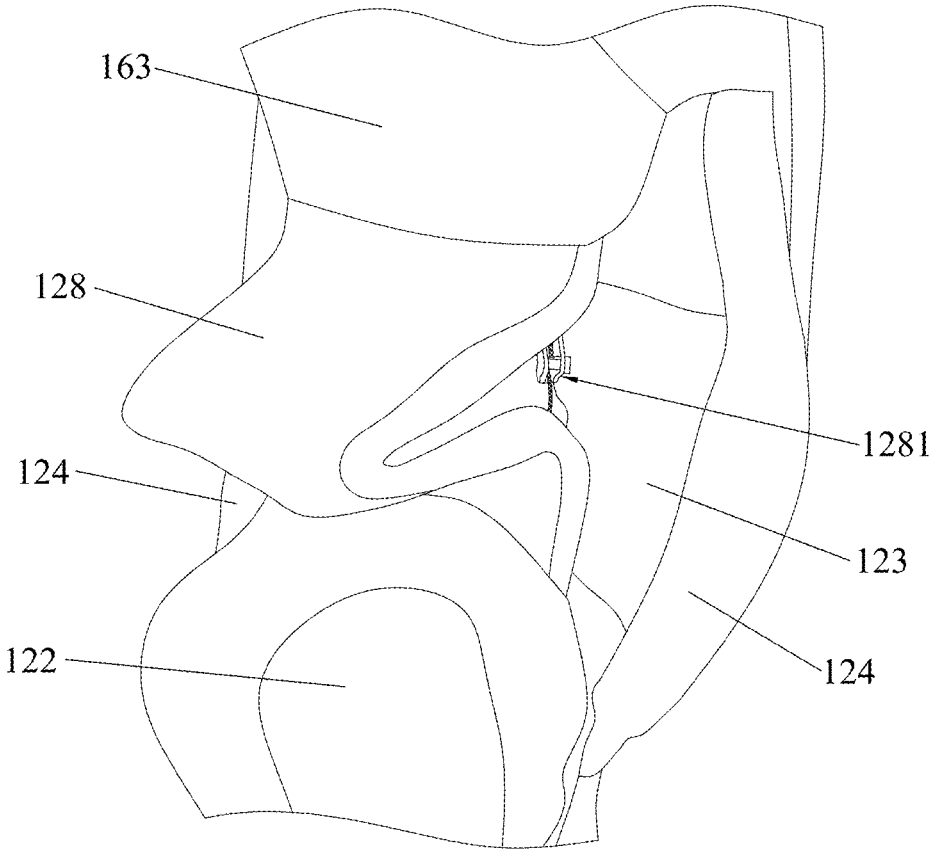
FIG. 25 is a schematic enlarged view illustrating the adjusted expandable part in the child carrier shown in FIG. 24.
Figure 26:
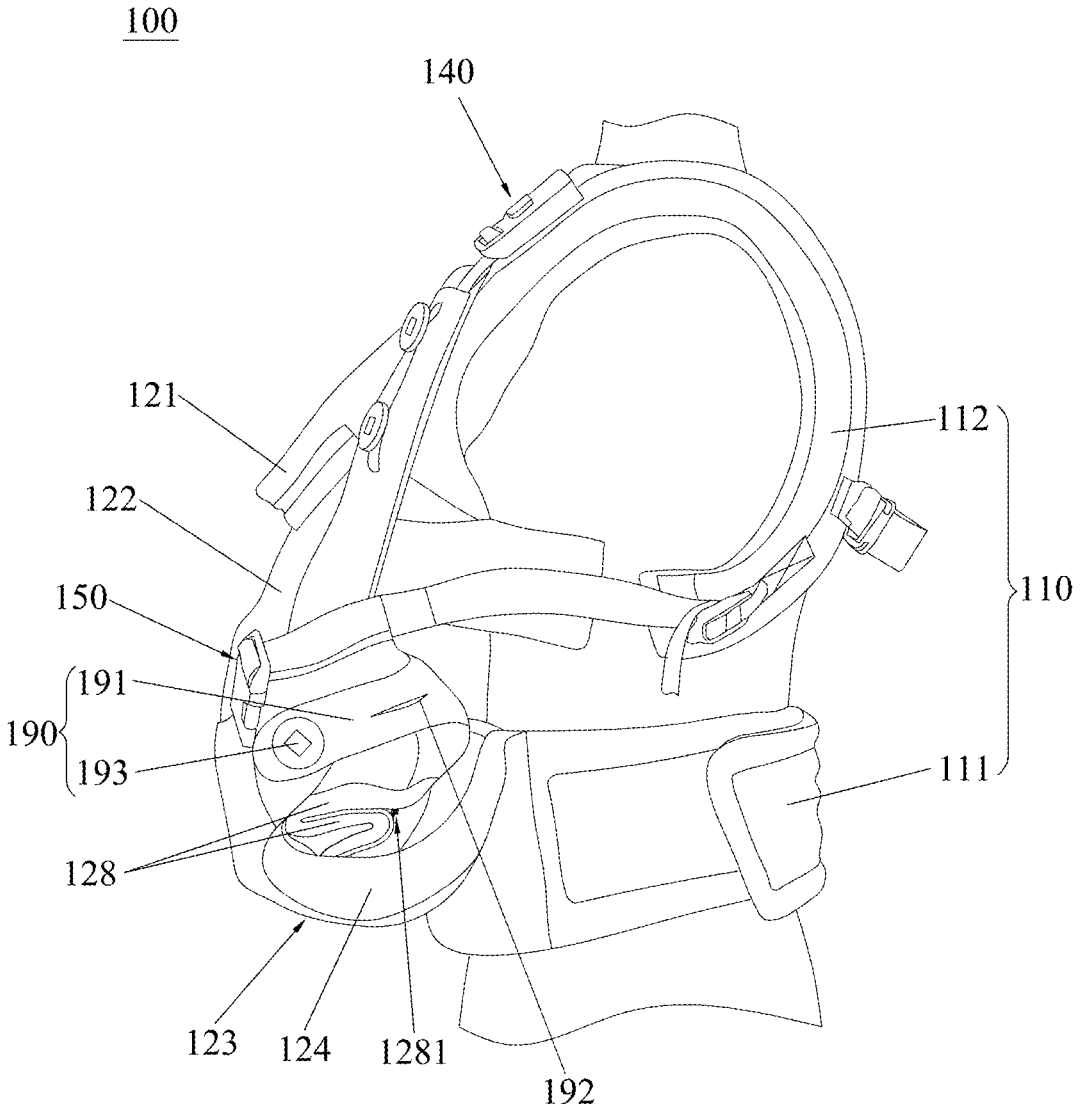
FIG. 26 is a schematic side view illustrating the child carrier of FIG. 24 in an installed configuration.

According to an example of construction, the fastening structure 1281 may include a zip fastener including two rows of protruding teeth that spaced apart from each other along the lengthwise direction of the expandable part 128 and extend along a width direction of the child supporting part 120, the two rows of protruding teeth being operable to engage with and disengage from each other. When the two rows of protruding teeth are engaged with each other, the fastening structure 1281 is in a fastened state with the expandable part 128 folded to reduce the effective length of the expandable part 128 as shown in FIGS. 25 and 26, which can reduce the greatest bottom distance between the torso support portion 122 and the carrying harness 110. When the two rows of protruding teeth are disengaged from each other, the fastening structure 1281 is in an unfastened state with the expandable part 128 expandable as shown in FIG. 22 to increase the effective length of the expandable part 128, which can increase the greatest bottom distance between the torso support portion 122 and the carrying harness 110. In other words, the greatest bottom distance allowed between the torso support portion 122 and the carrying harness 110 is smaller when the fastening structure 1281 is in the fastened state than when the fastening structure 1281 is in the unfastened state. During use, the expandable part 128 may be thereby adjusted in accordance with the size of a child to set a suitable bottom distance between the torso support portion 122 and the body of the caregiver carrying the child with the child carrier 100.

Although the aforementioned example provides a zip fastener for the fastening structure 1281, it will be appreciated that other constructions may be suitable. For example, some variant constructions for the fastening structure 1281 may include, without limitation, button fasteners, snap fasteners, buckle fasteners, hook and loop fasteners, and the like. Moreover, the fastening structure 1281 may include multiple fastening positions so that more than two greatest bottom distances may be desirably set between the torso support portion 122 and the carrying harness 110.

According to an embodiment, the child carrier 100 including both the expandable part 128 and the hip support adjustment 130 described herein may offer more flexibility in adjusting the torso support portion 122 and the hip support portion 123 of the child supporting part 120 in accordance with the size of a child and/or the sitting configuration of the child. Accordingly, the child carrier 100 can provide a more comfortable environment for the child.

Figure 16:
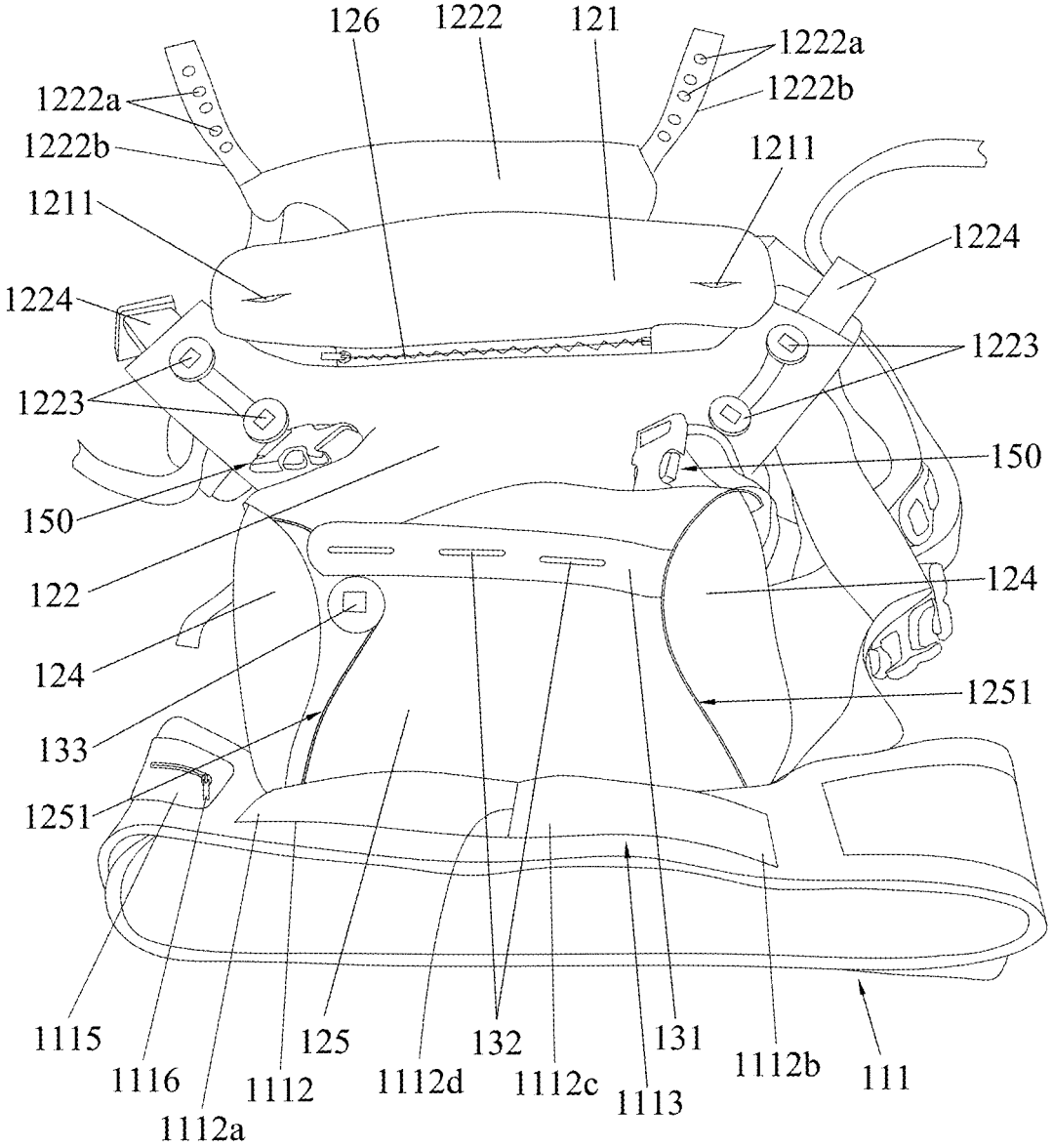
FIG. 16 is a schematic view illustrating another variant construction that may be applied in an embodiment of the child carrier.
Figure 17:
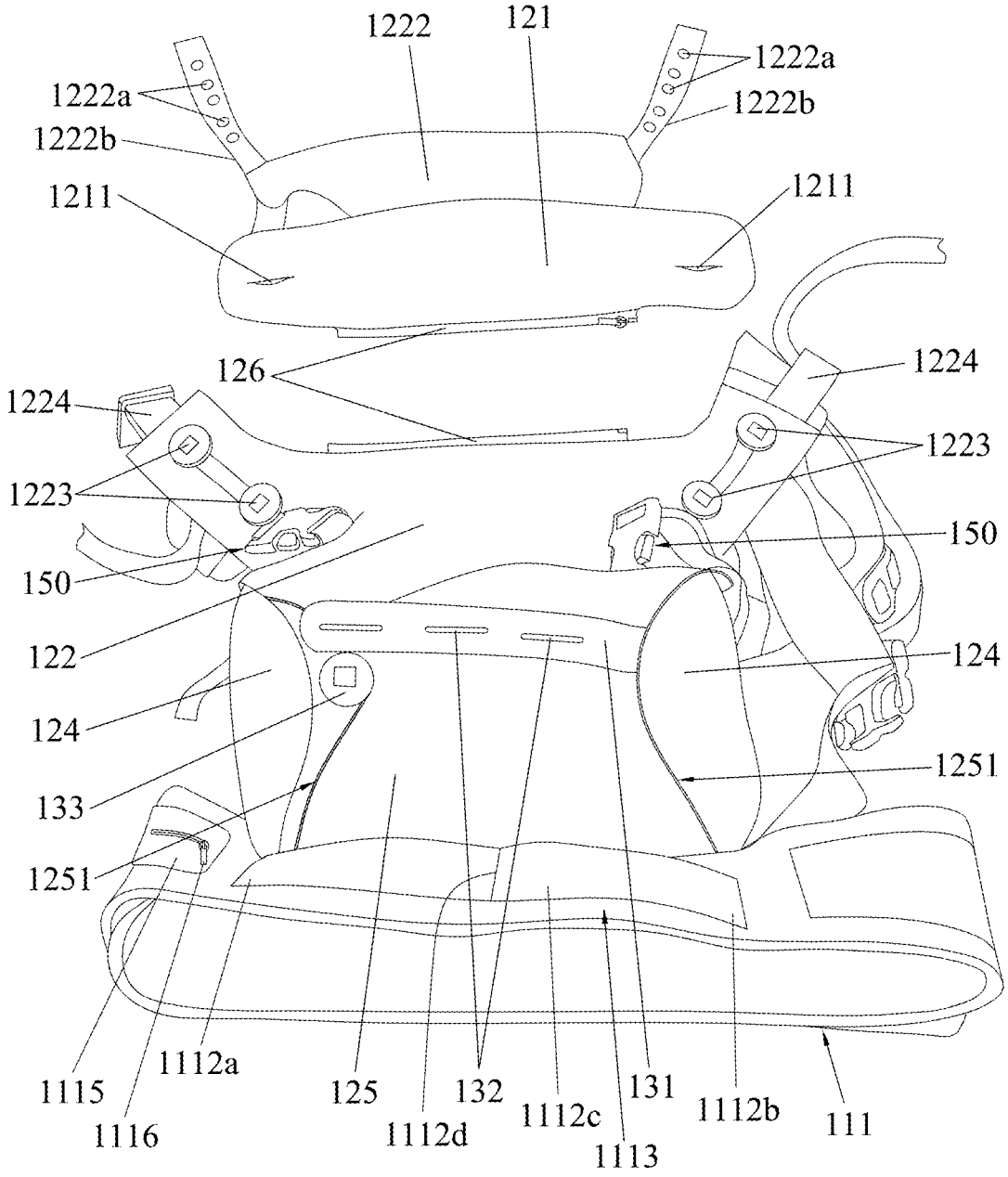
FIG. 17 is a schematic view illustrating the child carrier of FIG. 16 with a neck support portion detached from a torso support portion.
Figure 18:
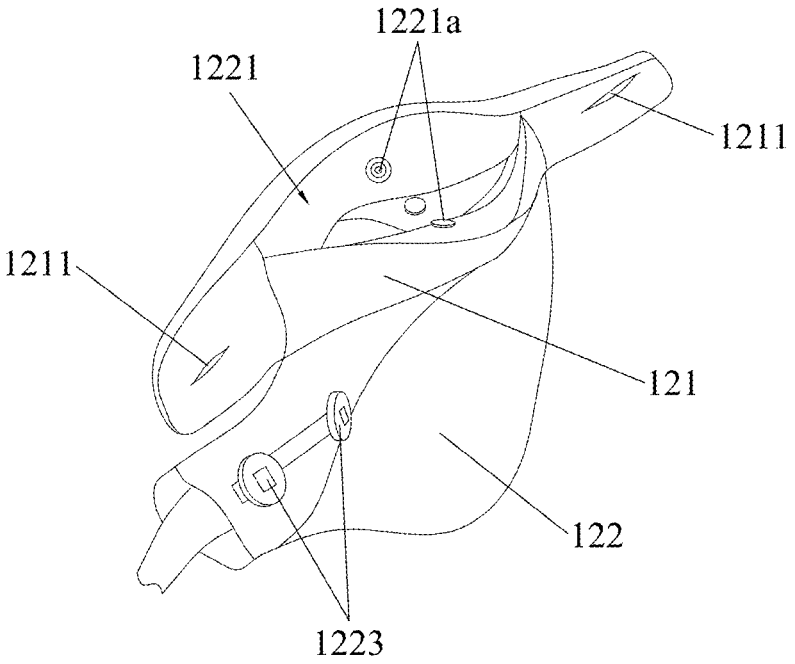
FIG. 18 is a schematic enlarged view illustrating further construction details of the neck support portion provided in the child carrier of FIG. 16.
Figure 19:
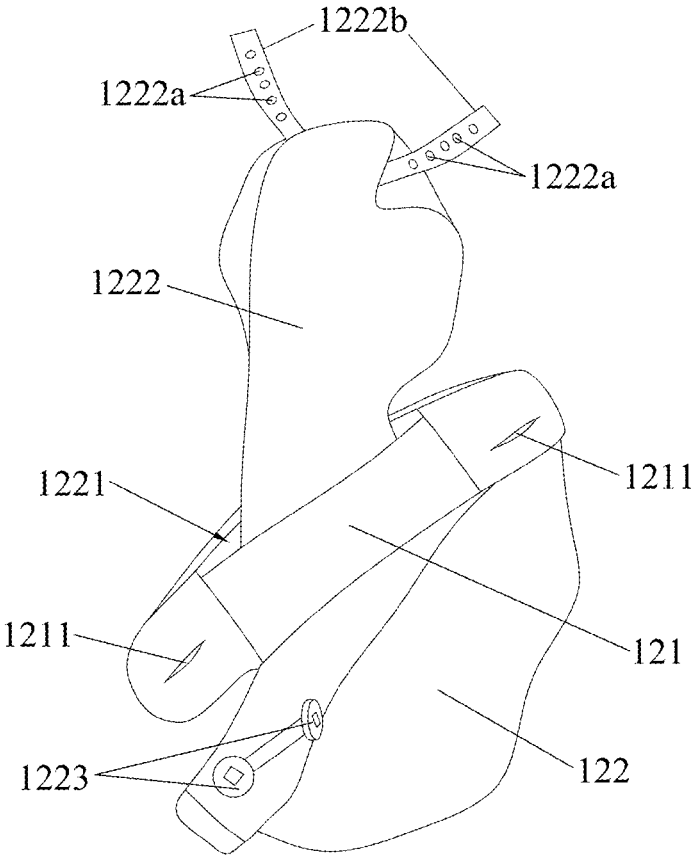
FIG. 19 is a schematic enlarged view illustrating a head cover deployed outside the neck support portion shown in FIG. 18.

Referring to FIGS. 16 and 17, a utility feature that may be provided in an embodiment of the child carrier 100 may include a utility holder band 1112 attached to the waist strap 111. Examples of suitable materials for the utility holder band 1112 may include, without limitation, fabrics and soft goods. The utility holder band 1112 can extend along the waist strap 111, and can have two opposite ends 1112*a* and 1112*b* fixedly attached to the waist strap 111 so that an intermediate portion 1112*c* of the utility holder band 1112 between the two ends 1112*a* and 1112*b* is movable away from the waist strap 111 to form a gap 1113 between the waist strap 111 and the intermediate portion 1112*c*. When more than one gap 1113 is to be formed, the utility holder band 1112 may further be fixedly attached to the waist strap 111 at another location 1112*d* between the two ends 1112*a* and 1112*b*. The waist strap 111 can thereby receive one or more object hung on the utility holder band 1112. For example, an object having a catch may be hung on the utility holder band 1112 with the catch received at least partially through the gap 1113. For convenient use, the utility holder band 1112 may be positioned on the waist strap 111 at a location that can be easily accessed by a caregiver. For example, the utility holder band 1112 may be positioned on the waist strap 111 adjacent to the hip support portion 123. In this manner, one or more objects may be hung on the utility holder band 1112 below a child supported by the child supporting part 120 in a use configuration.

Referring again to FIGS. 16 and 17, a further utility feature of the child carrier 100 may include a storage compartment 1115 provided on the waist strap 111. The storage compartment 1115 may be fixedly attached to the waist strap 111 at a distance from the utility holder band 1112. For example, the storage compartment 1115 may be directly sewed onto the waist strap 111. The storage compartment 1115 may have an opening that can be closed and opened with a fastening part 1116. According to an example of construction, the fastening part 1116 may be a zip fastener. It will be appreciated, however, that the fastening part 1116 may include other suitable constructions including, without limitation, button fasteners, snap fasteners, hook and loop fasteners, and the like. A caregiver may place objects or items of relatively small sizes in the storage compartment 1115, such as keys, cards, etc. According to an example of construction, the storage compartment 1115 may be disposed at a location on the waist strap 111 that corresponds to a left or a right side of a caregiver's body when the waist strap 111 is attached around the caregiver's waist.

The embodiments and constructions described herein provide multiple features that may be advantageously applied in a child carrier. These features may be implemented separately or in any suitable combinations various embodiments of the child carrier as needed.

Realization of the child carrier has been described in the context of particular embodiments. These embodiments are meant to be illustrative and not limiting. Many variations, modifications, additions, and improvements are possible. These and other variations, modifications, additions, and improvements may fall within the scope of the invention as defined in the claims that follow.

What is claimed is:

1. A child carrier comprising:

a carrying harness including a waist strap and two shoulder straps; and a child supporting part connected with the carrying harness, the child supporting part including a torso support portion and a neck support portion detachably connected with each other via a fastener, wherein the fastener is engaged to connect the neck support portion with the torso support portion and disengaged to remove the neck support portion from the torso support portion;

wherein each of the two shoulder straps has a fixed end fixedly connected with the waist strap, and a distal end operable to detachably fasten to the waist strap or the torso support portion, the torso support portion further being operable to detachably fasten to each of the two shoulder straps at an intermediate position between the fixed end and the distal end thereof.

2. The child carrier according to claim 1, wherein the fastener includes a zip fastener, a snap fastener, a button fastener or hook and loop fasteners.

3. The child carrier according to claim 1, wherein the neck support portion is foldable over the torso support portion for adjusting the neck support portion between a plurality of vertical positions relative to the torso support portion.

4. The child carrier according to claim 3, wherein the neck support portion has two end portions transversally opposite to each other that are respectively provided with two first fastening parts, and each of a left and a right side of the torso support portion respectively has a plurality of second fastening parts operable to engage with and disengage from the first fastening parts, wherein the two first fastening parts of the neck support portion respectively engage with two upper ones of the second fastening parts on the left and right sides of the torso support portion to hold the neck support portion in a first vertical position relative to the torso support portion, and engage with two lower ones of the second fastening parts on the left and right sides of the torso support portion to hold the neck support portion in a second vertical position relative to the torso support portion.

5. The child carrier according to claim 4, wherein the first fastening parts are openings, and the second fastening parts are buttons.

6. The child carrier according to claim 1, further including a bib installable on the child supporting part to at least partially cover the neck support portion.

7. The child carrier according to claim 6, wherein the neck support portion is foldable over the torso support portion for adjusting the neck support portion between a plurality of vertical positions relative to the torso support portion, and the bib is installable with the neck support portion in any of the vertical positions relative to the torso support portion.

8. The child carrier according to claim 6, wherein the bib includes a transversal portion, and two side portions protruding from the transversal portion at two opposite sides thereof.

9. The child carrier according to claim 6, wherein the bib is detachably fastened to the neck support portion and/or the torso support portion.

10. The child carrier according to claim 6, wherein the torso support portion has a plurality of fastening parts operable to engage with the bib to hold the bib in position.

11. The child carrier according to claim 10, wherein the fastening parts include buttons.

12. The child carrier according to claim 10, wherein the neck support portion is foldable over the torso support portion for adjusting the neck support portion to a desirable vertical position relative to the torso support portion, and the fastening parts on the torso support portion are operable to respectively engage with the neck support portion and the bib to hold the neck support portion in the desirable vertical position and the bib adjacent to the neck support portion.

13. The child carrier according to claim 6, wherein the two shoulder straps respectively have two first connectors, and the child supporting part further has two belt portions that are respectively attached to the torso support portion and are respectively provided with two second connectors operable to engage with the two first connectors, the bib when installed on the neck support portion at least partially covering the two belt portions.

14. A child carrier comprising:

a carrying harness;

a child supporting part connected with the carrying harness, the child supporting part including a torso support portion and a neck support portion connected with each other; and a bib installable on the child supporting part to at least partially cover the neck support portion;

wherein the neck support portion is foldable over the torso support portion for adjusting the neck support portion to a desirable vertical position relative to the torso support portion, and the torso support portion includes a plurality of fastening parts each of which is operable to respectively engage with the neck support portion and the bib to hold the neck support portion in the desirable vertical position and the bib in position adjacent to the neck support portion.

15. The child carrier according to claim 14, wherein the bib includes a transversal portion, and two side portions protruding from the transversal portion at two opposite sides thereof.

16. The child carrier according to claim 14, wherein the fastening parts include buttons.

17. The child carrier according to claim 14, wherein the carrying harness includes two shoulder straps respectively having two first connectors, and the child supporting part further has two belt portions that are respectively attached to the torso support portion and are respectively provided with two second connectors operable to engage with the two first connectors, the bib when installed on the neck support portion at least partially covering the two belt portions.

18. The child carrier according to claim 14, wherein the torso support portion and the neck support portion are detachably connected with each other via a fastener, the fastener being engaged to connect the neck support portion with the torso support portion and disengaged to remove the neck support portion from the torso support portion.

19. The child carrier according to claim 18, wherein the fastener includes a zip fastener, a snap fastener, a button fastener or hook and loop fasteners.

* * * * *